US009514869B2

(12) United States Patent
Miwa et al.

(10) Patent No.: US 9,514,869 B2
(45) Date of Patent: Dec. 6, 2016

(54) R-T-B BASED SINTERED MAGNET

(71) Applicant: TDK CORPORATION, Tokyo (JP)

(72) Inventors: Masashi Miwa, Tokyo (JP); Haruna Nakajima, Tokyo (JP); Ken-ichi Nishikawa, Tokyo (JP); Tetsuya Hidaka, Tokyo (JP); Jun Hagiwara, Tokyo (JP); Chikara Ishizaka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 70 days.

(21) Appl. No.: 14/378,432

(22) PCT Filed: Feb. 13, 2013

(86) PCT No.: PCT/JP2013/054065

§ 371 (c)(1),
(2) Date: Aug. 13, 2014

(87) PCT Pub. No.: WO2013/122256

PCT Pub. Date: Aug. 22, 2013

(65) Prior Publication Data

US 2015/0155083 A1 Jun. 4, 2015

(30) Foreign Application Priority Data

Feb. 13, 2012 (JP) ..... 2012-028960
Mar. 30, 2012 (JP) ..... 2012-079608

(51) Int. Cl.
*H01F 1/057* (2006.01)
*C22C 38/00* (2006.01)
(Continued)

(52) U.S. Cl.
CPC ..... *H01F 1/057* (2013.01); *C22C 38/00* (2013.01); *C22C 38/002* (2013.01);
(Continued)

(58) Field of Classification Search
CPC ..... H01F 1/0577
See application file for complete search history.

(56) References Cited

U.S. PATENT DOCUMENTS

2007/0125452 A1 6/2007 Hirota et al.
2010/0007232 A1 1/2010 Komuro et al.
(Continued)

FOREIGN PATENT DOCUMENTS

CN 1983471 A 6/2007
EP 1 005 050 A2 5/2000
(Continued)

OTHER PUBLICATIONS

Li , Acta Materialia, 2011, vol. 59, 3061-3069.*
(Continued)

*Primary Examiner* — Jie Yang
*Assistant Examiner* — Xiaowei Su
(74) *Attorney, Agent, or Firm* — Oliff PLC

(57) ABSTRACT

The present invention provides an R-T-B based sintered magnet including $R_2T_{14}B$ crystal grains wherein; a grain boundary is formed by two or more adjacent $R_2T_{14}B$ crystal grains, an R—O—C concentrated part, in which concentrations of R, O and C are higher than those in the $R_2T_{14}B$ crystal grains respectively, is in the grain boundary, and an area of the R—O—C concentrated part occupying in that of the grain boundary on a cut surface of the R-T-B based sintered magnet is within a range of 10% or more to 75% or less.

19 Claims, 12 Drawing Sheets

(51) Int. Cl.

| | |
|---|---|
| ***C22C 38/06*** | (2006.01) |
| ***C22C 38/10*** | (2006.01) |
| ***C22C 38/14*** | (2006.01) |
| ***C22C 38/16*** | (2006.01) |
| ***H01F 7/02*** | (2006.01) |
| *B22F 3/10* | (2006.01) |

(52) U.S. Cl.

CPC ..... *C22C 38/005* (2013.01); *C22C 38/06* (2013.01); *C22C 38/10* (2013.01); *C22C 38/14* (2013.01); *C22C 38/16* (2013.01); *H01F 1/0577* (2013.01); *H01F 7/02* (2013.01); *B22F 3/10* (2013.01)

(56) References Cited

U.S. PATENT DOCUMENTS

| | | | | |
|---|---|---|---|---|
| 2011/0260565 | A1 | 10/2011 | Nakajima | |
| 2012/0025651 | A1 | 2/2012 | Komuro et al. | |
| 2013/0092868 | A1* | 4/2013 | Nakajima et al. | 252/62.51 R |
| 2013/0099150 | A1 | 4/2013 | Nakajima et al. | |

FOREIGN PATENT DOCUMENTS

| | | | |
|---|---|---|---|
| EP | 1 462 531 | A2 | 9/2004 |
| JP | A-4-6806 | | 1/1992 |
| JP | A-4-116144 | | 4/1992 |
| JP | A-4-330702 | | 11/1992 |
| JP | A-2005-191282 | | 7/2005 |
| JP | A-2007-157903 | | 6/2007 |
| WO | WO 2010/073533 | A1 | 7/2010 |
| WO | WO 2010/109760 | A1 | 9/2010 |
| WO | 2012/002059 | A1 | 1/2012 |
| WO | WO 2012002060 | A1 * | 1/2012 |

OTHER PUBLICATIONS

Aug. 19, 2014 translation of International Preliminary Report on Patentability issued in International Application No. PCT/JP2013/054065.

Jul. 14, 2015 Office Action issued in U.S. Appl. No. 14/378,428.

Dec. 3, 2015 Office Action issued in U.S. Appl. No. 14/378,428.

U.S. Appl. No. 14/378,428, filed Aug. 13, 2014 in the name of Miwa et al.

Minowa T., et al. "Microstructure of Nd-Rich Phase in Nd—Fe—B Magnet Containing Oxygen and Carbon Impurities", Journal of Magnetism and Magnetic Materials 97 (1991) pp. 107-111.

Corfield M.R., et al., "Influence of Oxygen Content on Grain Growth in Pr—Fe—B/Nd—Fe—B Sintered Magnets", Journal of Alloys and Compounds 463 (2008) pp. 180-188.

Sep. 30, 2016 Office Action issued in U.S. Appl. No. 14/378,428.

Sepehri-Amin et al., "Grain boundary and interface chemistry of an Nd-Fe-B-based sintered magnet," Acta Materialia, 60 (2012), 819-830.

* cited by examiner

R-O-C CONCENTRATED PART

R-O-C-N CONCENTRATED PART

R-T-B BASED SINTERED MAGNET

TECHNICAL FIELD

The present invention relates to an R-T-B based sintered magnet having rare earth elements (R), at least one or more kind of transition metal elements (T), essentially including Fe or Fe and Co, and Boron (B) as its main component.

RELATED ART

Although said R-T-B ("R" represents one or more kinds of rare earth elements and "T" represents one or more kinds of transition metal elements including Fe or Fe and Co) based sintered magnet shows excellent magnetic properties, it tends to show a low corrosion resistance due to an inclusion of easily oxidizing rare earth elements as its main component.

Therefore, in order to improve corrosion resistance of the R-T-B based sintered magnet, magnetic body is generally surface treated by such as resin coating, plating and the like. On the other hand, addition elements or internal structure of magnetic body have been changed to improve corrosion resistance of the magnetic body itself. Said improvement of corrosion resistance of magnetic body itself is extremely important to heighten reliability of a surface treated product; which is also advantageous for reducing cost of the product by allowing a simple surface treatment application, relative to resin coating or plating.

Conventionally, for instance, patent document 1 suggests a technique to improve corrosion resistance of a magnet by reducing carbon content in a permanent-magnet alloy to 0.04 mass % or less and preventing intermetallics R—C of rare earth element and carbon in a non-magnetic R-rich phase to 1.0 mass % or less. In addition, patent document 2 suggests a technique to improve corrosion resistance by setting Co concentration in an R-rich phase to 5 to 12 mass %.

PRIOR ART

Patent Document

Patent document 1: Japanese Laid-Open Patent Publication No. H04-330702

Patent document 2: Japanese Laid-Open Patent Publication No. H04-6806

SUMMARY OF THE INVENTION

Problems to be Solved by the Invention

However, with the conventionally used R-T-B based sintered magnet, water such as water vapor in a used environment oxidizes "R" in the R-T-B based sintered magnet and generates hydrogen; and then an R-rich phase in grain boundary absorbs said hydrogen which progresses corrosion of the R-rich phase, and deteriorates magnetic properties of the R-T-B based sintered magnet.

In addition, as suggested in patent document 1, it is required to greatly reduce an additive amount of lubricant, added to improve magnetic field orientation when pressing in a magnetic field, in order to reduce carbon content in a magnet alloy to 0.04 mass % or less. Therefore, degree of orientation of magnetic particles in a green compact decreases and residual magnetic flux density Br after sintering decreases, and that a magnet having sufficient magnetic properties cannot be obtained.

On the other hand, as suggested in patent document 2, it is required to increase Co additive amount in a raw material composition in order to increase Co concentration in an R-rich phase. However, it is unable to increase Co concentration only in the R-rich phase since Co also substitutes Fe in a main phase of $R_2T_{14}B$ phase; and thus, it is required to add Co beyond that required in the R-rich phase. Therefore, production cost rises by increasing used amount of the expensive Co, and magnetic properties decrease by substituting Fe in a main phase with Co more than necessary.

The present invention has been made by considering the above circumstances, and an object of the present invention is to provide an R-T-B based sintered magnet having an excellent corrosion resistance and good magnetic properties.

Solution to Problem

In order to solve the above-mentioned problems and to achieve the object, the present inventors have pursued extensive studies about a mechanism of the R-T-B based sintered magnet corrosion. As a result, they have found the followings. First, it will accelerate the changes of an R-rich phase to hydroxide by storing hydrogen ($H_2$), produced by corrosion reaction of water such as water vapor under used environment and "R" in the R-T-B based sintered magnet, in the R-rich phase present in a grain boundary in the R-T-B based sintered magnet. And then, a crystal grain (a main phase grain) constituting a main phase of the R-T-B based sintered magnet falls off from the R-T-B based sintered magnet, and a corrosion of "R" progresses inside the R-T-B based sintered magnet at an accelerated pace, due to a volume expansion of the R-T-B based sintered magnet associated with a hydrogen storage in the R-rich phase and a change of the R-rich phase to hydroxide. Therefore the present inventors have pursued extensive studies about a method preventing hydrogen storage in a grain boundary. And they have found that a hydrogen storage in a grain boundary can be prevented, and thus, corrosion resistance of the R-T-B based sintered magnet can be improved to a large extent and good magnetic properties can be obtained by forming a predetermined amount of R—O—C concentrated part, wherein concentrations of rare earth (R), oxygen (O) and carbon (C) are higher than those in $R_2T_{14}B$ crystal grains, or R—O—C—N concentrated part, wherein concentrations of rare earth (R), oxygen (O), carbon (C) and nitrogen (N) are higher than those in $R_2T_{14}B$ crystal grains, in a grain boundary (a polycrystalline grain boundary part formed by three or more adjacent $R_2T_{14}B$ crystal grains, in particular) formed by two or more adjacent $R_2T_{14}B$ crystal grains in the R-T-B based sintered magnet. The present invention has been made based on the above findings.

The R-T-B based sintered magnet according to the present invention is an R-T-B based sintered magnet comprising $R_2T_{14}B$ crystal grains wherein; a grain boundary is formed by two or more adjacent $R_2T_{14}B$ crystal grains, an R—O—C concentrated part, in which concentrations of R, O and C are higher than those in the $R_2T_{14}B$ crystal grains respectively, is in the grain boundary, and an area of the R—O—C concentrated part occupying in that of the grain boundary on a cut surface of the R-T-B based sintered magnet is within a range of 10% or more to 75% or less.

The R—O—C concentrated part is an area wherein concentrations of R, O and C present in a grain boundary are higher than those in $R_2T_{14}B$ crystal grains, respectively; and the area is present in a grain boundary formed by two or more adjacent crystal grains. In case when an area of the R—O—C concentrated part occupying in that of a grain boundary on a cut surface of the R-T-B based sintered magnet is within a range of 10% or more to 75% or less, storage of hydrogen, produced by the corrosion reaction, in a grain boundary can be effectively prevented, and inner progress of "R" corrosion can be prevented. And thus, corrosion resistance of the R-T-B based sintered magnet can be improved to a large extent, and good magnetic properties can be obtained as well.

In addition, according to the present invention, a ratio (O/R) of O atom to R atom in the above R—O—C concentrated part preferably satisfies the following formula (1). When (O/R) in the grain boundary of R—O—C concentrated part is within a range satisfying the following formula, storage of hydrogen, produced by a corrosion reaction of water and "R" in the R-T-B based sintered magnet, in a grain boundary can be effectively prevented, and inner progress of corrosion can be prevented. Therefore, corrosion resistance of the R-T-B based sintered magnet can further be improved and good magnetic properties can be obtained as well.

$$0<(O/R)<1 \quad (1)$$

Further, according to the present invention, the above R—O—C concentrated part preferably has a cubic crystal structure. With this cubic crystal structure, further hydrogen storage in a grain boundary can be prevented, and corrosion resistance can be improved.

Further, according to the present invention, an area of the above R—O—C concentrated part occupying in the above-described grain boundary is preferably within a range of 35% or more to 75% or less. This enables further prevention of inner progress of "R" corrosion; and then corrosion resistance of the R-T-B based sintered magnet can further be improved and it can show good magnetic properties.

Further, according to the present invention, an amount of oxygen included in the above R-T-B based sintered magnet is preferably 2000 ppm or less. By setting said amount of oxygen included in the R-T-B based sintered magnet within the above range, a ratio of R—O—C concentrated part can be set within a preferable range, decrease of coercivity HcJ and residual magnetic flux density Br can be prevented, and it can show good magnetic properties.

Further, according to the present invention, "R" included in the above R—O—C concentrated part preferably includes RL (a rare earth element at least includes either or both of Nd and Pr) and RH (a rare earth element at least includes either or both of Dy and Tb). With the inclusion of RL and RH in the R—O—C concentrated part, it can show an excellent corrosion resistance and its magnetic properties can be further improved.

Further, the R-T-B based sintered magnet according to the present invention is an R-T-B based sintered magnet comprising $R_2T_{14}B$ crystal grains wherein; a grain boundary is formed by two or more adjacent $R_2T_{14}B$ crystal grains, an R—O—C—N concentrated part, in which concentrations of R, O, C and N are higher than those in the $R_2T_{14}B$ crystal grains respectively, is in the grain boundary, and an area of the R—O—C—N concentrated part occupying in that of the grain boundary on a cut surface of the R-T-B based sintered magnet is within a range of 10% or more to 75% or less.

The R—O—C—N concentrated part is an area wherein concentrations of R, O, C and N present in a grain boundary are higher than those in $R_2T_{14}B$ crystal grains, respectively; and the area is present in a grain boundary formed by two or more adjacent crystal grains. In case when an area of the R—O—C—N concentrated part occupying in that of a grain boundary on a cut surface of the R-T-B based sintered magnet is within a range of 10% or more to 75% or less, storage of hydrogen, produced by the corrosion reaction, in a grain boundary can be effectively prevented, and inner progress of "R" corrosion can be prevented. And thus, corrosion resistance of the R-T-B based sintered magnet can be improved to a large extent, and it can show good magnetic properties.

In addition, according to the present invention, a ratio (O/R) of O atom to R atom in the above R—O—C—N concentrated part preferably satisfies the following formula (1)'. When (O/R) in R—O—C—N concentrated part of the grain boundary is within a range satisfying the following formula, storage of hydrogen, produced by the corrosion reaction of water and "R" in the R-T-B based sintered magnet, in a grain boundary can be effectively prevented, and inner progress of corrosion can be prevented. Therefore, corrosion resistance of the R-T-B based sintered magnet can further be improved and good magnetic properties can be obtained as well.

$$0<(O/R)<1 \quad (1)'$$

Further, according to the present invention, the above R—O—C—N concentrated part preferably has a cubic crystal structure. With this cubic crystal structure, further hydrogen storage in a grain boundary can be prevented, and corrosion resistance can be improved.

Further, according to the present invention, an area of the above R—O—C—N concentrated part occupying in the above-described grain boundary is preferably within a range of 35% or more to 75% or less. This enables further prevention of inner progress of "R" corrosion; and then corrosion resistance of the R-T-B based sintered magnet can further be improved and it can show good magnetic properties.

Further, according to the present invention, an amount of oxygen included in the above R-T-B based sintered magnet is preferably 2000 ppm or less. By setting said amount of oxygen included in the R-T-B based sintered magnet within the above range, a ratio of R—O—C—N concentrated part can be within a preferable range, decrease of coercivity HcJ and residual magnetic flux density Br can be prevented, and it can show good magnetic properties.

Further, according to the present invention, "R" included in the above R—O—C—N concentrated part preferably includes RL (a rare earth element at least includes either or both of Nd and Pr) and RH (a rare earth element at least includes either or both of Dy and Tb). With the inclusion of RL and RH in the R—O—C—N concentrated part, it can show an excellent corrosion resistance and its magnetic properties can be further improved.

Effect of the Invention

According to the present invention, it enables to obtain an R-T-B based sintered magnet capable of showing an excellent corrosion resistance and good magnetic properties.

MODES FOR CARRYING OUT THE INVENTION

Figure 1:
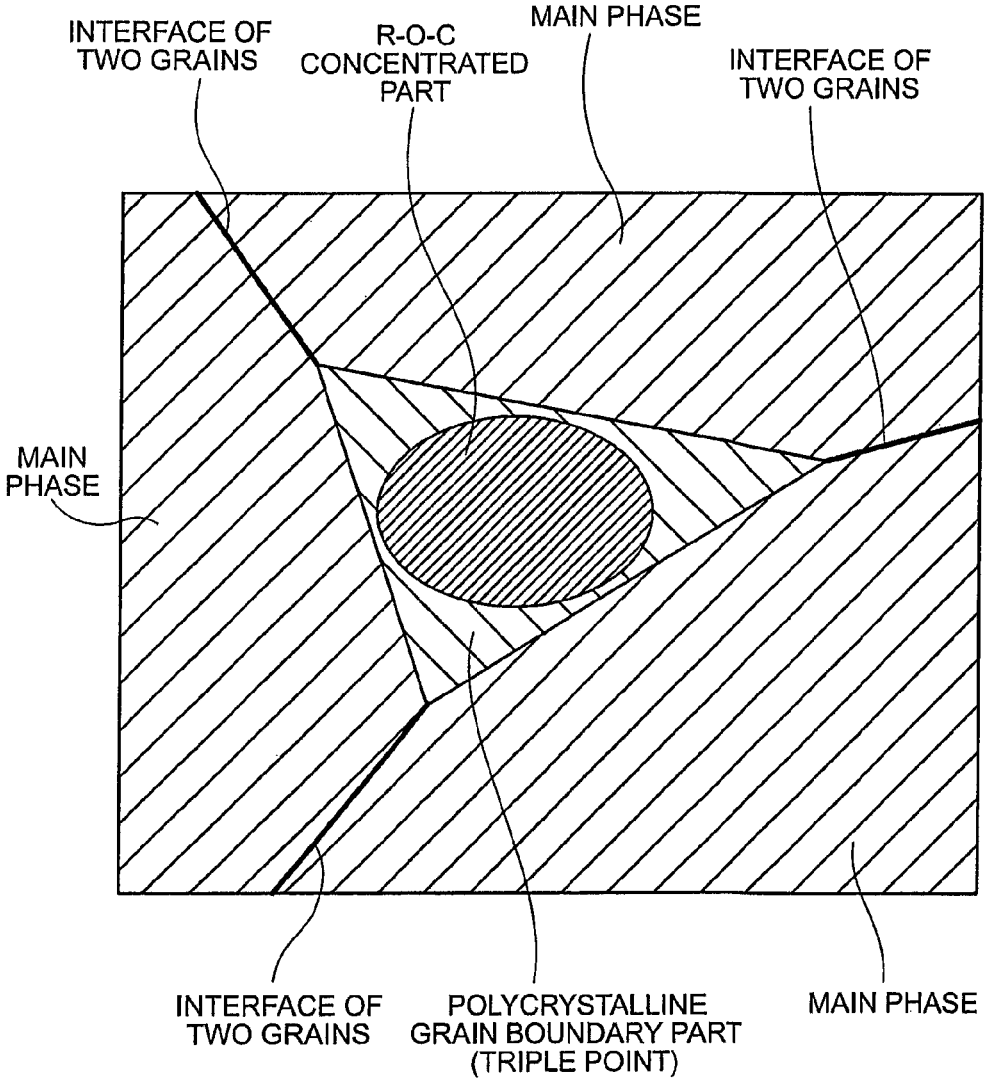
FIG. 1 is a schematic diagram showing a grain boundary formed by a plural number of $R_2T_{14}B$ crystal grains of the R-T-B based sintered magnet according to the first embodiment of the present invention.

The followings are the detailed explanations of the present invention by reference to Figures. Please note that the present invention is not limited to the following modes for carrying out the invention (hereinafter referred to as "embodiment"). Further, the constituent elements in the following embodiments include what a person ordinary skilled in the art can easily conceive of and matters that are substantially the same; namely they include the matters within the equivalent range. Further, it is possible appropriately to combine the constituent elements disclosed in the following embodiments.

First Embodiment

R-T-B Based Sintered Magnet

The followings are the explanation of an embodiment of an R-T-B based sintered magnet according to the first embodiment of the present invention. The R-T-B based sintered magnet according to the present embodiment is an R-T-B based sintered magnet comprising $R_2T_{14}B$ crystal grains wherein; a grain boundary is formed by two or more adjacent $R_2T_{14}B$ crystal grains, an R—O—C concentrated part, in which concentrations of R, O and C are higher than those in the $R_2T_{14}B$ crystal grains respectively, is in the grain boundary, and an area of the R—O—C concentrated part occupying in that of the grain boundary on a cut surface of the R-T-B based sintered magnet is within a range of 10% or more to 75% or less.

The grain boundary includes an interface of two grains formed by two adjacent $R_2T_{14}B$ crystal grains, and a polycrystalline grain boundary part (a triple point) formed by three or more adjacent $R_2T_{14}B$ crystal grains. In addition, said R—O—C concentrated part is present in a grain boundary formed by two or more adjacent crystal grains; and each concentration of R, O and C of said part is higher than that in $R_2T_{14}B$ crystal grains. As long as R, O and C are included as its main component, the other components may be included in the R—O—C concentrated part.

The R-T-B based sintered magnet according to the present embodiment is a sintered body formed by using an R-T-B based alloy. The R-T-B based sintered magnet according to the present embodiment comprises a main phase including $R_2T_{14}B$ compound, wherein a composition of a crystal grain is expressed by $R_2T_{14}B$ ("R" represents at least a kind of rare earth element and "T" represents at least a kind of transition metal element including Fe or Fe and Co and "B" represents B or B and C), and a grain boundary wherein "R" is included more than the $R_2T_{14}B$ compound.

"R" represents at least one kind of rare earth element. The rare earth elements are Sc, Y and lanthanoid elements, which belong to the third group of a long period type periodic table. The lanthanoid elements include La, Ce, Pr, Nd, Sm, Eu, Gd, Tb, Dy, Ho, Er, Tm, Yb, Lu and the like. The rare earth elements are classified to light rare earth and heavy rare earth. The heavy rare earth elements include Gd, Tb, Dy, Ho, Er, Tm, Yb and Lu, while light rare earth elements include the other rare earth elements. According to the present embodiment, "R" is preferable to include RL (rare earth elements including at least either or both of Nd and Pr) in view of production cost and magnetic properties; and further, "R" is more preferable to include both RL and RH (rare earth elements including at least either or both of Dy and Tb) in view of improving magnetic properties.

"T" represents one or more kinds of transition metal elements including Fe or Fe and Co. "T" may be Fe alone, or Fe partly substituted by Co. In case when Fe is partly substituted by Co, temperature properties can be improved without deteriorating magnetic properties. Further, Co content is desirable to suppress to 20 wt % or less, to the sum content of Co and Fe. This is due to a possibility of deteriorating magnetic properties when Fe is partly substituted to Co, making Co content with respect to Fe content larger than 20 wt %. And further, this is due to making the R-T-B based sintered magnet according to the present embodiment expensive. Ti, V, Cr, Mn, Ni, Cu, Zr, Nb, Mo, Hf, Ta, W and the like are exemplified as transition metal elements, other than Fe or Fe and Co. In addition, "T" may further include at least one kind of element such as Al, Ga, Si, Bi, Sn and the like, other than transition metal elements.

"B" may be partly substituted with carbon (C) in the R-T-B based sintered magnet according to the present embodiment. In this case, a production of the magnet becomes easy and its production cost can also be reduced. In addition, a substitution amount of "C" is an amount which substantially does no effect the magnetic properties.

Further, in addition, O, N, C, Ca and the like can be inevitably mixed. These can be included in an amount of approximately 0.5 wt % or less each.

A main phase of the R-T-B based sintered magnet according to the present embodiment is $R_2T_{14}B$ crystal grains; and said $R_2T_{14}B$ crystal grains have a crystal structure comprising $R_2T_{14}B$ type tetragonal. An average particle diameter of the $R_2T_{14}B$ crystal grain is generally 1 to 30 μm or so.

A grain boundary of the R-T-B based sintered magnet according to the present embodiment comprises an R-rich phase, wherein "R" content is higher than that in the R—O—C concentrated part or in the $R_2T_{14}B$ crystal grains. B-rich phase, wherein a compound ratio of boron (B) atom is high, may be included in the grain boundary other than said R-rich phase.

Content of "R" in the R-T-B based sintered magnet according to the present embodiment is 25 wt % or more to 35 wt % or less, preferably 28 wt % or more to 33 wt % or less. When said "R" content is less than 25 wt %, a generation of $R_2T_{14}B$ compound becoming a main phase of the R-T-B based sintered magnet is insufficient. Thus, there is a possibility of depositing a-Fe having a soft magnetism and deteriorating magnetic properties.

Content of "B" in the R-T-B based sintered magnet according to the present embodiment is 0.5 wt % or more to 1.5 wt % or less, preferably 0.8 wt % or more to 1.2 wt % or less, and the most preferably 0.8 wt % or more to 1.0 wt % or less. Coercivity HcJ tends to decrease when said "B" content is less than 0.5 wt %, while residual magnetic flux density Br tends to decrease when more than 1.5 wt %.

"T" represents one or more kinds of transition metal elements including Fe or Fe and Co, as mentioned above. "T" may be Fe alone, or Fe partly substituted by Co. Fe content in the R-T-B based sintered magnet according to the present embodiment is a substantial residue of a constituent of said R-T-B based sintered magnet; and Fe may be partly substituted by Co. When Fe is partly substituted by Co to include said Co, Co content is preferably 4 wt % or less, more preferably 0.1 wt % or more to 2 wt % or less, and the most preferably 0.3 wt % or more to 1.5 wt % or less. Ti, V, Cr, Mn, Ni, Cu, Zr, Nb, Mo, Hf, Ta, W and the like are exemplified as transition metal elements, other than Fe or Fe and Co. In addition, "T" may further include at least one kind of element such as Al, Ga, Si, Bi, Sn and the like, other than transition metal elements.

When including either or both of Al and Cu, a content of said either or both of Al and Cu in the R-T-B based sintered magnet according to the present embodiment is preferably 0.02 wt % or more to 0.6 wt % or less. Inclusion of one or two kinds of said Al and Cu within this range enables a higher coercivity, a higher corrosion resistance, and a temperature property improvement. Al content is preferably 0.03 wt % or more to 0.4 wt % or less, and more preferably 0.05 wt % or more to 0.25 wt % or less. On the other hand, Cu content is preferably 0.3 wt % or less (except not including zero), more preferably 0.2 wt % or less (except not including zero), and the most preferably 0.03 wt % or more to 0.15 wt % or less.

A certain amount of oxygen (O) should be included in the R-T-B based sintered magnet according to the present embodiment. Said certain amount is varied according to the other parameters, and is suitably determined. The amount of oxygen is preferably 500 ppm or more considering a corrosion resistance, and it is preferably 2000 ppm or less considering magnetic properties.

In addition, an amount of carbon (C) in the R-T-B based sintered magnet according to the present embodiment is varied according to the other parameters, and is suitably determined. Magnetic properties deteriorate when a carbon amount increases; while the R—O—C concentrated part is not formed when carbon amount is less. Thus, carbon amount is preferably 400 ppm or more to 3000 ppm or less, more preferably 400 ppm or more to 2500 ppm or less, and the most preferably 400 ppm or more to 2000 ppm or less.

Nitrogen (N) amount in the R-T-B based sintered magnet according to the present embodiment is preferably 1000 ppm or less, more preferably 800 ppm or less, and the most preferably 600 ppm or less.

A measurement method of oxygen amount, carbon amount and nitrogen amount in the R-T-B based sintered magnet may be a conventionally well-known method. For instance, oxygen amount may be measured by an inert gas fusion—non-dispersive infrared absorption method, carbon amount may be measured by combustion in an oxygen airflow—infrared absorption method, and nitrogen amount may be measured by an inert gas fusion—thermal conductivity method.

The R-T-B based sintered magnet according to the present embodiment comprises an R—O—C concentrated part, wherein concentrations of "R", "O" and "C" are higher than those in $R_2T_{14}B$ crystal grains respectively in its grain boundary. Note that, although the R—O—C concentrated part is mainly composed of "R", "O" and "C" as described above, the other components may be included.

FIG. 1 is a schematic diagram showing a grain boundary formed by a plural number of $R_2T_{14}B$ crystal grains of the R-T-B based sintered magnet according to the present embodiment. As shown in FIG. 1, the R—O—C concentrated part is formed in a grain boundary of the R-T-B based sintered magnet according to the present embodiment.

In the R-T-B based sintered magnet according to the present embodiment, an area of the R—O—C concentrated part occupying in that of a grain boundary in an arbitrary cut surface of the R-T-B based sintered magnet is within a range of 10% or more to 75% or less. Note that said arbitrary cut surface according to the present embodiment is a cross-section cut parallel to an axis of easy magnetization of the R-T-B based sintered magnet. In a case when an area of the R—O—C concentrated part occupying in that of a grain boundary in an arbitrary cut surface of the R-T-B based sintered magnet is 10% or less, a storage of hydrogen, produced by a corrosion reaction due to water such as water vapor in used environment, in a grain boundary cannot be sufficiently prevented, and a corrosion resistance of the R-T-B based sintered magnet according to the present embodiment is deteriorated. On the other hand, in case when an area of the R—O—C concentrated part occupying in that of a grain boundary in an arbitrary cut surface of the R-T-B based sintered magnet exceeds 75%, an R-rich phase required for an expression of coercivity HcJ in a grain boundary (an interface of two grains) formed by two $R_2T_{14}B$ crystal grains become insufficient, and coercivity HcJ of the R-T-B based sintered magnet according to the present embodiment is deteriorated. Considering above, by setting an area of the R—O—C concentrated part occupying in that of a grain boundary in an arbitrary cut surface of the R-T-B based sintered magnet within the above range, it effectively prevents a storage of hydrogen, generated by a reaction of water, such as water vapor in used environment invading inside the R-T-B based sintered magnet, and "R" in the R-T-B based sintered magnet. And thus, corrosion progress to the inner side of the R-T-B based sintered magnet can be prevented, as well as good magnetic properties can be obtained.

In the R-T-B based sintered magnet according to the present embodiment, an area of the R—O—C concentrated part occupying in that of a grain boundary in an arbitrary cut surface of the R-T-B based sintered magnet is preferably within a range of 35% or more to 75% or less. By setting an area of the R—O—C concentrated part occupying in that of a grain boundary in an arbitrary cut surface of the R-T-B based sintered magnet within the above range, it effectively prevents a storage of hydrogen, generated by a corrosion reaction of water, invading inside the R-T-B based sintered magnet, and "R" in the R-T-B based sintered magnet. Therefore, further progress of corrosion inside the R-T-B based sintered magnet can be prevented; and thus, corrosion resistance of the R-T-B based sintered magnet according to the present embodiment can further be improved as well as the R-T-B based sintered magnet according to the present embodiment shows good magnetic properties.

Due to a storage of hydrogen, produced by a corrosion reaction of water, such as water vapor in used environment, and "R" in the R-T-B based sintered magnet, in an R-rich phase present in a grain boundary of the R-T-B based sintered magnet, corrosion of the R-T-B based sintered magnet progresses inside the R-T-B based sintered magnet at an accelerated pace.

Namely, corrosion of the R-T-B based sintered magnet is considered to progress with the following processes. First, an R-rich phase present in a grain boundary is easily oxidized, and therefore "R" in R-rich phase present in a grain boundary is oxidized by water, such as water vapor of used environment, and then said "R" corrodes, changes to a hydroxide, and produces hydrogen during these processes.

$$2R+6H_2O \rightarrow 2R(OH)_3+3H_2 \quad \text{(I)}$$

Next, the produced hydrogen is stored in an uncorroded R-rich phase.

$$2R+xH_2 \rightarrow 2RH_X \quad \text{(II)}$$

And then, an R-rich phase easily corrodes due to the hydrogen storage; and hydrogen is produced in an amount more than the stored amount in the R-rich phase due to a corrosion reaction of the hydrogen stored R-rich phase and water.

$$2RH_X+6H_2O \rightarrow 2R(OH)_3+(3+x)H_2 \quad \text{(III)}$$

Corrosion of the R-T-B based sintered magnet progresses inside the R-T-B based sintered magnet by the above chain reactions (I) to (III); and an R-rich phase changes to an R hydroxide and to an R hydride. Stress is accumulated by a volume expansion associated with this change, which leads to a falling of crystal grain (a main phase grain) constituting a main phase of the R-T-B based sintered magnet. And then, a newly formed surface of the R-T-B based sintered magnet emerges due to the falling of crystal grain of the main phase, which leads to further progress of R-T-B based sintered magnet corrosion inside the R-T-B based sintered magnet.

Considering above, in the R-T-B based sintered magnet according to the present embodiment, an area of the R—O—C concentrated part occupying in that of a grain boundary in an arbitrary cut surface of the R-T-B based sintered magnet is set within a range of 10% or more to 75% or less. The R—O—C concentrated part is difficult to store hydrogen. Therefore, due to a predetermined amount of the R—O—C concentrated part formed in a grain boundary of an arbitrary cut surface of the R-T-B based sintered magnet, hydrogen produced by a corrosion reaction is prevented to be stored in an inner part of an R-rich phase; and thus, inner progress of corrosion by the above processes can be prevented. In addition, R—O—C concentrated part is difficult to be oxidized in relative to an R-rich phase, and that hydrogen production itself due to the corrosion can also be prevented. Therefore, according to the R-T-B based sintered magnet of the present embodiment, corrosion resistance of the R-T-B based sintered magnet can be improved to a large extent, showing good magnetic properties.

In addition, in an R—O—C concentrated part in a grain boundary of R-T-B based sintered magnet according to the present embodiment, a ratio (O/R) of O atom to R atom in the above R—O—C concentrated part preferably satisfies the following formula (1). Namely, (O/R) is preferably smaller than a stoichiometric ratio composition of R oxides ($R_2O_3$, $RO_2$, RO and the like). Note that a ratio of O atom to R atom is described as (O/R) in this specification. Due to a presence of R—O—C concentrated part having a predetermined range of (O/R) in its grain boundary, hydrogen, produced by a corrosion reaction of water and "R" in the R-T-B based sintered magnet, is effectively prevented to be stored in an inner R-rich phase; and corrosion progress to the inner side of the R-T-B based sintered magnet can be prevented as well as the R-T-B based sintered magnet of the present embodiment is able to show good magnetic properties.

$$0<(O/R)<1 \quad (1)$$

Further, said (O/R) is preferable to satisfy the following formula (2). In case when (O/R) is less than 0.4, a storage of hydrogen, produced by a corrosion reaction of water and "R" in the R-T-B based sintered magnet, cannot be sufficiently prevented; and corrosion resistance of the R-T-B based sintered magnet tends to deteriorate. While when (O/R) is more than 0.7, consistency with its main phase grain become worse and coercivity HcJ tends to be deteriorated.

$$0.4<(O/R)<0.7 \quad (2)$$

(O/R) is further preferable to satisfy the following formula (3). By setting (O/R) within the following formula (3), corrosion resistance of R-T-B based sintered magnet can be further improved.

$$0.5<(O/R)<0.7 \quad (3)$$

Further, the R—O—C concentrated part is preferable to comprise a cubic crystal structure. Further storage of hydrogen in a grain boundary can be prevented due to the inclusion of said cubic crystal structure; and corrosion resistance of the R-T-B based sintered magnet according to the present embodiment can be improved.

"R" included in the R—O—C concentrated part preferably includes RL (a rare earth element at least includes either or both of Nd and Pr) and RH (a rare earth element at least includes either or both of Dy and Tb). An excellent corrosion resistance will be shown and its magnetic properties can be further improved, due to the inclusion of RL and RH in the R—O—C concentrated part.

As mentioned below, the R-T-B based sintered magnet according to the present embodiment can be manufactured by adding a predetermined amount of raw materials, which are an oxygen source and a carbon source different from the R-T-B based raw material alloy, to the R-T-B based raw material alloy, and by controlling manufacturing conditions such as an oxygen concentration in an atmosphere of production processes.

Powders including an oxide of element "M", wherein a standard producing free energy of its oxide is higher than that of a rare earth element oxide, can be used for an oxygen source of the R—O—C concentrated part. A carbide of an element "M'", wherein a standard producing free energy of its carbide is higher than that of a rare earth element carbide, powders including carbon such as graphite, carbon black and the like, and an organic compound which produces carbon by a thermal decomposition can be used for a carbon source of the R—O—C concentrated part. In addition, surface oxidized metal particles can be used as the oxygen source, and metal particles including carbide such as cast iron can be used as the carbon source.

The R—O—C concentrated part formed in a grain boundary of the R-T-B based sintered magnet according to the present embodiment is produced by the following method. Namely, M oxide included in the added oxygen source has higher standard producing free energy relative to that of an oxide of rare earth element "R". Therefore, when manufacturing a sintered body by adding an oxygen source and a carbon source to R-T-B based raw material alloy and sintering the same, the M oxide is reduced by R-rich liquid phase generated during said sintering; and M metal and "O" are produced. Further, when adding M' (standard producing free energy of its carbide is higher than that of a rare earth element carbide) carbide as a carbon source, M' metal and "C" are produced likewise. These M metal and M' metal are stored in a $R_2T_{14}B$ crystal or an R-rich phase. On the other hand, "O" and "C" react with a part of an R-rich phase and deposit in a grain boundary, a polycrystalline grain boundary part in particular, as R—O—C concentrated part.

With the conventional R-T-B based sintered magnet, "O" is included as an inevitable impurity such as by an oxidization of raw material powders when pressing in an atmosphere. However, "O" included at this time is in a form of R oxide due to an oxidization of rare earth element "R" in raw material powders; and that it is considered not to be reduced during sintering process and deposit in a grain boundary in a form of R oxide, an unchanged form.

On the other hand, during manufacturing process of the R-T-B based sintered magnet according to the present embodiment, formation of R oxide is controlled by performing each process of pulverization, pressing and sintering of a raw material alloy in an extremely low oxygen concentration (e.g. around 100 ppm or less) atmosphere. Thus, "O" generated by an reduction of M oxide during sintering process and "C" added as a carbon source are considered to deposit in a grain boundary in a form of R—O—C concentrated part. Namely, R oxide deposit in a grain boundary with a conventional method, while according to a method of the present embodiment, predetermined amount of R—O—C concentrated part is possible to deposit while controlling a formation of R oxides in grain boundary.

Further, other than the R—O—C concentrated part, R—C concentrated area, wherein R concentration and C concentration are higher than those of $R_2T_{14}B$ crystal grains, R—O concentrated area (including R oxide), wherein R concentration and O concentration are higher than those of $R_2T_{14}B$ crystal grains, and the like are included in a grain boundary. In addition, other than above, an R-rich phase, wherein R concentration is higher than that of $R_2T_{14}B$ crystal grains, is present. Although a certain amount of said R-rich phase is required for an expression of coercivity HcJ, R—C concentrated area and R—O concentrated area are preferable to be less. For instance, the R—C concentrated area is preferable to be 30% or less of the grain boundary area, and R—O concentrated area is preferable to be 10% or less of the grain boundary area. This is due to a fact that an excess of said R—C concentrated area tends to decrease corrosion resistance of R-T-B based sintered magnet, and an excess of R—O concentrated area tends to decrease residual magnetic flux density Br of R-T-B based sintered magnet.

Therefore, the R-T-B based sintered magnet according to the present embodiment is a magnet wherein a predetermined amount of R—O—C concentrated part is formed in its grain boundary. By setting an area of the R—O—C concentrated part occupying in that of a grain boundary in an arbitrary cut surface of the R-T-B based sintered magnet within a predetermined range, hydrogen storage in a grain boundary can be prevented and progress of R corrosion inside the magnet can be prevented. And thus, R-T-B based sintered magnet according to the present embodiment comprises an excellent corrosion resistance, as well as good magnetic properties.

Further, the R-T-B based sintered magnet according to the present embodiment is generally used after shaping in an arbitrary form. A shape of the R-T-B based sintered magnet according to the present embodiment is not particularly limited; and it may be a columnar shape such as a rectangular parallelepiped, a hexahedron, a tabular, a quadratic pole and the like. A cross-sectional shape of the R-T-B based sintered magnet may be an arbitrary shape such as C-shaped cylindrical shape. Bottom surface of the quadrangular column may be a rectangle or a square.

The R-T-B based sintered magnet according to the present embodiment includes both a magnet product magnetized after machining the present magnet and a magnet product of the present magnet which is unmagnetized.

<Manufacturing Method of the R-T-B Based Sintered Magnet>

Figure 2:
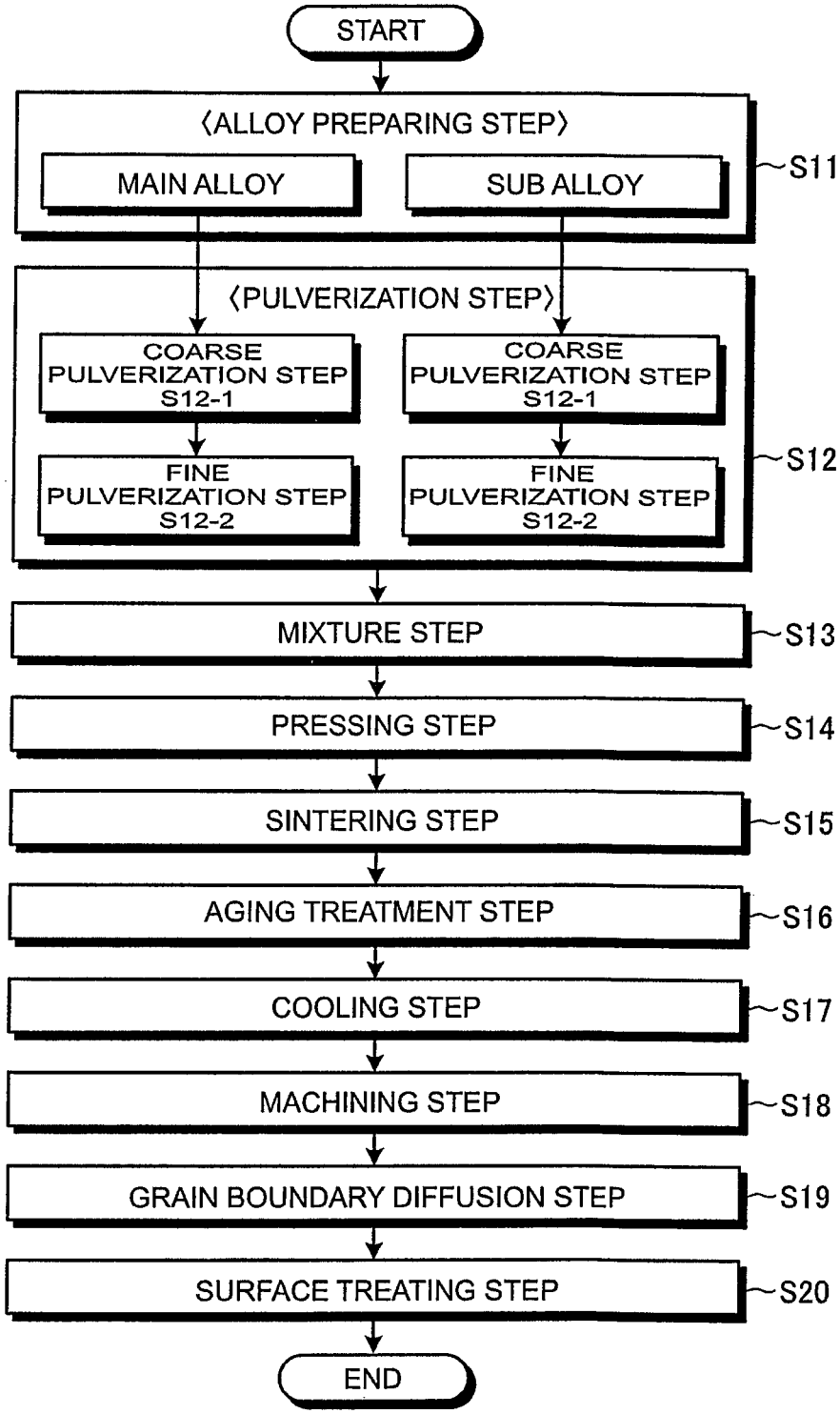
FIG. 2 is a flow chart showing an example of a production method of the R-T-B based sintered magnet according to the first embodiment of the present invention.

An example of manufacturing method of the R-T-B based sintered magnet according to the present embodiment comprising the above structures is described referring to drawings. FIG. 2 is a flow chart indicating an example of manufacturing method of R-T-B based sintered magnet according to an embodiment of the present invention. As shown in FIG. 2, a manufacturing method of the R-T-B based sintered magnet according to the present embodiment comprises the following steps.

(a) Alloy preparing step wherein a main alloy and a sub alloy are prepared (Step S11).
(b) Pulverization step wherein the main alloy and the sub alloy are pulverized (Step S12).
(c) Mixture step wherein a main alloy powder and a sub alloy powder are mixed (Step S13).
(d) Pressing step wherein the mixed powder is pressed (Step S14).
(e) Sintering step wherein the green compact is sintered and an R-T-B based sintered magnet is obtained (Step S15).
(f) Aging treatment step wherein the R-T-B based sintered magnet is age treated (Step S16).
(g) Cooling step wherein the R-T-B based sintered magnet is cooled (Step S17).
(h) Machining step wherein the R-T-B based sintered magnet is machined (Step S18).
(i) Grain boundary diffusion step wherein a heavy rare earth element is diffused in a grain boundary of the R-T-B based sintered magnet (Step S19).
(j) Surface treating step wherein the R-T-B based sintered magnet is surface treated (Step S20).

[Alloy Preparing Step: Step S11]

An alloy having a composition constituting a main phase (a main alloy) and the same constituting a grain boundary (a sub alloy) are prepared (an alloy preparing step (Step S11)). In this alloy preparing step (Step S11), raw material metals, corresponding a composition of R-T-B based sintered magnet according to the present embodiment, are melted in vacuum or in an inert gas atmosphere of an inert gas such as Ar gas; and by casting thereof, a main alloy and a sub alloy each having a desired composition are manufactured. Note that although a two-alloy method, wherein a raw material powder is manufactured by mixing two alloys of the main alloy and the sub alloy, is described in the present embodiment, a one-alloy method, wherein a single alloy in which the main alloy and the sub alloy are not separated, may be used.

For instance, a rare earth metal, a rare earth alloy, a pure iron, ferro-boron, and further, their alloys and compounds can be used as raw material metals. A casting method, wherein a raw material metal is casted, includes such as an ingot casting method, a strip casting method, a book molding method, a centrifugal casting method and the like. In case when performing solidification segregation, the obtained raw material alloy is homogenized when required. The homogenization of the raw material alloy is performed by holding in an atmosphere of vacuum or inert gas at a temperature of 700° C. or more to 1500° C. or less for an hour. Thus, an alloy for R-T-B based sintered magnet is melted and homogenized.

[Pulverization Step: Step S12]

After the main alloy and the sub alloy are manufactured, said main alloy and said sub alloy are pulverized (a pulverization step (Step S12)). According to this pulverization step (Step S12), after the main alloy and the sub alloy are manufactured, said main alloy and said sub alloy are separately pulverized to make powders. Note that, although these main alloy and sub alloy may be pulverized together, these are preferably separately pulverized in view of suppressing their composition deviation.

A pulverization step (Step S12) includes a coarse pulverization step (Step S12-1), pulverized until a particle diameter is approximately a several hundred μm to a several mm, and a fine pulverization step (Step S12-2), pulverized until a particle diameter is approximately a several μm.

(Coarse Pulverization Step (Step S12-1))

A main alloy and a sub alloy are coarsely pulverized until each particle diameter is approximately a several hundred μm to a several mm. A coarse pulverized powder of the main alloy and the same of the sub alloy are thus obtained. The coarse pulverization is performed by the following steps. Hydrogen is stored in the main alloy and the sub alloy, and then said hydrogen is emitted. And with this dehydrogenation, pulverization of a self-collapsed type (a hydrogen storage pulverization) is able to be generated on the basis of a difference of capable hydrogen storage amount among the phases. Further, the coarse pulverization step (Step S12-1) can be performed by using a coarse pulverizer such as a stamp mill, a jaw crusher, a brown mill and the like, in an inert gas atmosphere, other than using the above-mentioned hydrogen storage pulverization.

Further, an atmosphere of each step, from a pulverization step (Step S12) to a sintering step (Step S15), is preferable to control to have a low oxygen concentration, in order to obtain high magnetic properties. Oxygen concentration is adjusted by such as controlling an atmosphere of each manufacturing step. In case when an oxygen concentration of each manufacturing step is high, a rare earth element in a powder of a main alloy and a sub alloy is oxidized generating an R oxide, and deposit in a grain boundary without being reduced during sintering, which leads to a decrease of Br of the obtained R-T-B based sintered magnet. Considering above, oxygen concentration in each step is preferably 100 ppm or less.

(Fine Pulverization Step: Step S12-2)

After a coarse pulverization of the main alloy and the sub alloy, the obtained coarse pulverized powders of said main alloy and said sub alloy are finely pulverized till their average particle diameter is approximately several μm (a fine pulverization step (Step S12-2)). Fine pulverized powders of a main alloy and a sub alloy are then obtained. Fine pulverized powders of a main alloy and a sub alloy having a particle diameter of preferably 1 μm or more to 10 μm or less, more preferably 3 μm or more to 5 μm or less can be obtained by further finely pulverizing the coarse pulverized powders.

Note that, although the fine pulverized powder is obtained by separately pulverizing the main alloy and the sub alloy in the present embodiment, said fine pulverized powders may be obtained after mixing the coarse pulverized powder of the main alloy and that of the sub alloy in a fine pulverization step (Step S12-2).

The fine pulverization is performed by suitably adjusting conditions such as pulverization time and the like, and by performing further pulverization to the coarse pulverized powder using a fine pulverizer such as jet mill, ball mill, vibrating mill, wet attritor and the like. The jet mill performs the following pulverization method. The jet mill discharges inert gas (e.g. $N_2$ gas) from a narrow nozzle at high pressure and produces a high speed gas flow. Coarse pulverized powders of a main alloy and a sub alloy are accelerated with this high speed gas flow, causing an impact among coarse pulverized powders of the main alloy and among the same powders of the sub alloy, or causing an impact between said coarse pulverized powders and a target or a container wall.

Addition of pulverization aids, such as zinc stearate, oleic amide and the like, when finely pulverizing the coarse pulverized powder of a main alloy and a sub alloy allows to obtain a fine pulverized powder which enables high orientation at pressing.

[Mixture Step: Step S13]

After the fine pulverization of the main alloy and the sub alloy, each fine pulverized powders are mixed in a low oxygen atmosphere (a mixture step (Step S13)). A mixed powder is then obtained. A low oxygen atmosphere is an inert gas atmosphere such as $N_2$ gas, Ar gas atmosphere and the like. Compounding ratio of the main alloy powders and the sub alloy powders is preferably 80/20 or more to 97/3 or less in weight ratio, more preferably 90/10 or more to 97/3 or less in weight ratio.

Further, in the pulverization step (Step S12), a compounding ratio of the main alloy and the sub alloy when pulverized together can be the same with a compounding ratio of the main alloy and the sub alloy when pulverized separately. Said compounding ratio of the main alloy and the sub alloy is preferably 80/20 or more to 97/3 or less in weight ratio, more preferably 90/10 or more to 97/3 or less in weight ratio.

An oxygen source and a carbon source, different from a raw material alloy, are added to the mixed powder. In case when a predetermined amount of an oxygen source and a carbon source, different from a raw material alloy, are added to the mixed powder, an R—O—C concentrated part in object is formed in a grain boundary, formed by adjacent two or more $R_2T_{14}B$ crystal grains of the obtained R-T-B based sintered magnet.

Powders including an oxide of element "M", wherein a standard producing free energy of its oxide is higher than that of a rare earth element oxide, can be used as an oxygen source. Although Al, Fe, Co, Zr and the like can be exemplified as "M" in concrete, it is not limited thereto. In addition, a surface oxidized metal particles may be used.

A carbide of an element "M'", wherein a standard producing free energy of its carbide is higher than that of a rare earth element carbide, powders including carbon such as graphite, carbon black and the like, and an organic compound which produces carbon by a thermal decomposition or so can be used for the carbon source. Although Si, Fe and the like can be exemplified as "M" in concrete, it is not limited thereto. In addition, a powder including a carbide such as cast iron may be used.

An appropriate additive amount of the oxygen source and the carbon source varies according to a composition of a raw material alloy, in particular, to an amount of rare earth. Therefore, in order to form an area ratio of the R—O—C concentrated part in object according to a composition of the used alloy, an additive amount of the oxygen source and the carbon source is adjusted. An excess of the required additive amount of the oxygen source and the carbon source leads to an excessive increase of R—O—C concentrated part area. Thus, it tends to decrease HcJ of the obtained R-T-B based sintered magnet, and there is a tendency that sufficient corrosion resistance cannot be obtained by forming R—O concentrated area, R—C concentrated area and the like. While, a predetermined area of R—O—C concentrated part cannot be obtained with too little of the required additive amount of the oxygen source and the carbon source.

Although an adding method of the oxygen source and the carbon source is not particularly limited, it is preferable to add when mixing fine pulverized powder, or to add to a coarse pulverized powder before fine pulverization.

[Pressing Step: Step S14]

After mixing the main alloy powder and the sub alloy powder, a mixed powder is pressed to an objective form (a pressing step (Step S14)). In a pressing step (Step S14), a mixed powder of a main alloy powder and a sub alloy powder is filled in a press mold held by an electromagnet, and pressed thereof to form the mixed powder to an arbitrary shape. Magnetic field is applied during this time, and a predetermined orientation is produced to a raw material powder by the application. Pressing is performed in the magnetic field with crystal axis oriented. Thus, a green compact is obtained. As the obtained green compact is oriented to a particular direction, an anisotropy R-T-B based sintered magnet with more strong magnetism can be obtained.

Pressurization when pressing is preferably 30 MPa to 300 MPa. Magnetic field application is preferably performed in a magnetic field of 950 kA/m to 1600 kA/m. Magnetic field application is not limited to a magnetostatic field, and it can also be a pulsed magnetic field. In addition, a magnetostatic field and a pulsed magnetic field can be used together.

Note the pressing method includes a wet pressing, in addition to a dry pressing mentioned above. The dry pressing is performed by directly pressing the mixed powder, while the wet pressing is performed by pressing a slurry wherein a raw material powder is dispersed in a solvent such as an oil.

A shape of a green compact obtained by pressing the mixed powder is not particularly limited; and it may be an arbitrary shape in accordance with a shape of desired R-T-B based sintered magnet such as a rectangular parallelepiped, a tabular shape, a columnar shape, a ring shape, and the like.

[Sintering Step: Step S15]

A green compact, obtained by pressing to an objective shape in a magnetic field, is sintered in a vacuum or an inert gas atmosphere; and R-T-B based sintered magnet is obtained (a sintering step (Step S15)). A sintering temperature is required to be adjusted considering all the conditions, such as composition, pulverization method, a difference between particle diameter and particle diameter distribution and the like; and a green compact is sintered by performing a heat treatment in a vacuum or in the presence of inert gas at 1000° C. or more to 1200° C. or less for an hour or more to 10 hours or less. Thus, a mixed powder produces a liquid phase sintering, and then an R-T-B based sintered magnet (a sintered body of R-T-B based sintered magnet) wherein a volume ratio of main phase is increased can be obtained. After sintering the green compact, a sintered body is preferable to rapidly cool to improve production efficiency.

[Aging Treatment Step: Step S16]

After sintering the green compact, the R-T-B based sintered magnet is age treated (an aging treatment step (Step S16)). After sintering, an aging treatment is performed to the R-T-B based sintered magnet, such as by holding the obtained R-T-B based sintered magnet in a temperature that is lower than a sintering temperature. Treatment conditions of the aging treatment are suitably adjusted considering a number of times of performing the aging treatment. For instance, it may be a two heating step comprising a heating step at 700° C. or more to 900° C. or less for 1 to 3 hours, and further, a heating step at 500° C. to 700° C. for 1 to 3 hours, or may be a one heating step comprising a heating step at around 600° C. for 1 to 3 hours. Such aging treatment can improve magnetic properties of the R-T-B based sintered magnet. In addition, an aging treatment step (Step S16) can be performed after a machining step (Step S18) or a grain boundary diffusion step (Step S19).

[Cooling Step: Step S17]

After an aging treatment is performed to the R-T-B based sintered magnet, said R-T-B based sintered magnet is rapidly cooled in Ar gas atmosphere (a cooling step (Step S17)). The R-T-B based sintered magnet according to the present embodiment is thus obtained. Cooling rate is not particularly limited, and it is preferably 30° C./min. or more.

[Machining Step: Step S18]

The obtained R-T-B based sintered magnet may be machined to a desired shape when required (a machining step: Step S18). The machining method exemplifies a shaping process, such as cutting, grinding and the like, and a chamfering process such as barrel polishing and the like.

[Grain Boundary Diffusion Step: Step S19]

A step wherein heavy rare earth element is further diffused in a grain boundary of the machined R-T-B based sintered magnet may be performed (a grain boundary diffusion step: Step S19). Grain boundary diffusion is performed by following methods: a method wherein a compound including a heavy rare earth element is adhered on the surface of R-T-B based sintered magnet by application, deposition and the like, and then heat treating thereof, or a method wherein a heat treatment is performed to the R-T-B based sintered magnet in an atmosphere including a vapor of heavy rare earth element. With this step, coercivity of the R-T-B based sintered magnet can be further improved.

[Surface Treating Step: Step S20]

A surface treatment, such as plating, resin coating, oxidize treatment, chemical conversion treatment and the like, can be performed to the R-T-B based sintered magnet obtained by the above steps (a surface treating step (Step S20)). Thus, the corrosion resistance can be further improved.

Note that, although the machining step (Step S18), the grain boundary diffusion step (Step S19) and the surface treating step (Step S20) are performed in the present embodiment, these steps are not necessary performed.

As mentioned above, the R-T-B based sintered magnet according to the present embodiment is manufactured as above, finishing all the treatments. In addition, a magnet product can be obtained by magnetizing thereof.

Thus obtained R-T-B based sintered magnet according to the present embodiment comprises R—O—C concentrated part in its grain boundary, and an area of the R—O—C concentrated part occupying in that of a grain boundary on a cut surface of the R-T-B based sintered magnet is within a range of 10% or more to 75% or less. The R-T-B based sintered magnet according to the present embodiment shows an excellent corrosion resistance, as well as good magnetic properties, by having a predetermined amount of R—O—C concentrated part in its grain boundary.

In case when used as a magnet for a rotary machine such as motor, thus obtained R-T-B based sintered magnet according to the present embodiment can be used over a long term due to its high corrosion resistance, providing a high reliable R-T-B based sintered magnet. The R-T-B based sintered magnet according to the present embodiment can be preferably used as a magnet of surface magnet type (Surface Permanent Magnet: SPM) motor wherein a magnet is attached on the surface of a rotor, an interior magnet embedded type (Interior Permanent Magnet: IPM) motor such as inner rotor type brushless motor, PRM (Permanent magnet Reluctance Motor) and the like. In concrete, the R-T-B based sintered magnet according to the present embodiment is preferably used for a spindle motor for a hard disk rotary drive or a voice coil motor of a hard disk drive, a motor for an electric vehicle or a hybrid car, an electric power steering motor for an automobile, a servo motor for a machine tool, a motor for vibrator of a cellular phone, a motor for a printer, a motor for a magnet generator and the like.

<Motor>

Figure 3:
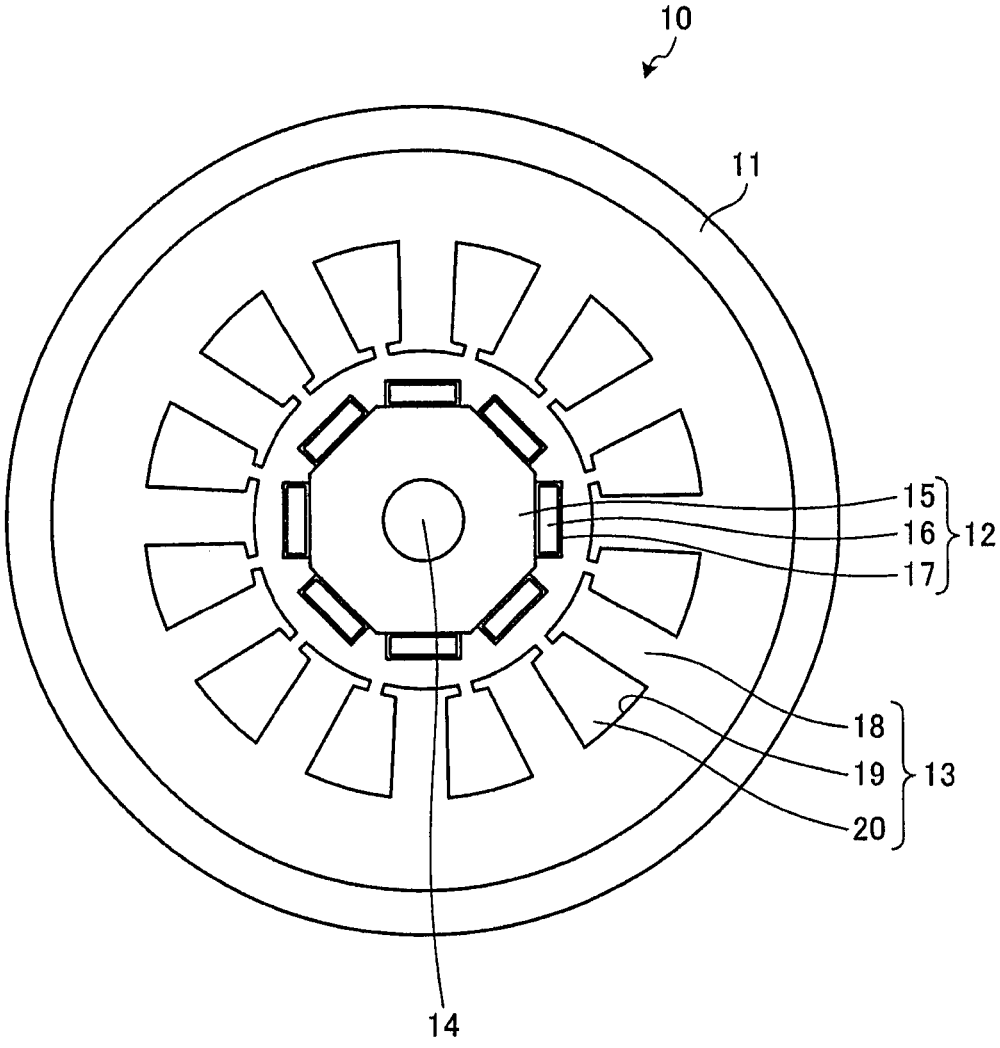
FIG. 3 is a cross-sectional view briefly showing the structure of a motor according to an embodiment.

Next, a preferable embodiment of the R-T-B based sintered magnet according to the present embodiment used as a motor will be described. Here, an example of the R-T-B based sintered magnet according to the present embodiment applied to SPM motor is described. FIG. 3 is a cross-sectional view briefly showing an embodiment of the structure of SPM motor. As shown in FIG. 3, SPM motor 10 comprises a columnar shaped rotor 12, a cylindrical shaped stator 13 and rotary shaft 14 in a housing 11. Rotary shaft 14 goes through a center of cross-section of rotor 12. Rotor 12 comprises a columnar shaped rotor core (iron core) 15 of iron material and the like, a plural number of permanent magnets 16 arranged at a predetermined interval on outer peripheral surface of rotor core 15 and a plural number of magnet insert slots 17 containing the permanent magnet 16. The R-T-B based sintered magnet according to the present embodiment is used for the permanent magnet 16. A plural number of the permanent magnets 16 are set so as to arrange N-pole and S-pole alternately in each magnet insert slot 17 along a circumferential direction of the rotor 12. Thus, adjacent permanent magnets 16 generate magnetic field lines in mutually reversed directions along radial direction of rotor 12. Stator 13 comprises a plural number of stator cores 18 and throttles 19, arranged at a predetermined interval along a circumferential direction of inner side of its cylindrical wall (peripheral wall) and along outer peripheral surface of rotor 12. Said plural number of stator cores 18 are arranged so as to be directed toward stator 13 and opposed to rotor 12. Further, coil 20 is wound around inside the each throttle 19. A permanent magnet 16 and stator core 18 are set so as to be opposed mutually. Rotor 12, together with rotary shaft 14, is turnably installed in a space in stator 13. Stator 13 provides torque to rotor 12 by an electromagnetic action, and rotor 12 rotates along circumferential direction.

SPM motor 10 uses the R-T-B based sintered magnet according to the present embodiment as a permanent magnet 16. The permanent magnet 16 shows a corrosion resistance while showing high magnetic properties. SPM motor 10 is thus capable of improving motor characteristics, such as a torque characteristic, and showing a high output for a long term; and that said SPM motor 10 is excellent in reliability.

Second Embodiment

R-T-B Based Sintered Magnet

The followings are the explanation of an embodiment of an R-T-B based sintered magnet according to the second embodiment of the present invention. The R-T-B based sintered magnet according to the present embodiment is an R-T-B based sintered magnet comprising $R_2T_{14}B$ crystal grains wherein; a grain boundary is formed by two or more adjacent $R_2T_{14}B$ crystal grains, an R—O—C—N concentrated part, in which concentrations of R, O, C and N are higher than those in the $R_2T_{14}B$ crystal grains respectively, is in the grain boundary, and an area of the R—O—C—N concentrated part occupying in that of the grain boundary on a cut surface of the R-T-B based sintered magnet is within a range of 10% or more to 75% or less.

The R—O—C—N concentrated part is present in a grain boundary formed by two or more adjacent crystal grains; and a concentration of each R, O, C and N of said part is higher than that in $R_2T_{14}B$ crystal grains. As long as R, O, C and N are included as its main component, the other components may be included in the R—O—C—N concentrated part.

The R-T-B based sintered magnet according to the present embodiment is a sintered body formed by using an R-T-B based alloy. The R-T-B based sintered magnet according to the present embodiment comprises a main phase including $R_2T_{14}B$ compound, wherein a composition of a crystal grain is expressed by $R_2T_{14}B$ and a grain boundary wherein "R" is included more than the $R_2T_{14}B$ compound.

"R" represents at least one kind of rare earth element. "R" is the same with "R" in $R_2T_{14}B$ compound included in a main phase of the R-T-B based sintered magnet according to the above first embodiment, and the description will be omitted.

"T" represents one or more kinds of transition metal elements including Fe or Fe and Co. "T" is the same with "T" in $R_2T_{14}B$ compound included in a main phase of the R-T-B based sintered magnet according to the above first embodiment, and the description will be omitted.

Similarly with the main phase of the R-T-B based sintered magnet according to the above first embodiment, "B" may be partly substituted with carbon (C) in the R-T-B based sintered magnet according to the present embodiment.

Further, in addition, similarly with the main phase of the R-T-B based sintered magnet according to the above first embodiment, O, N, C, Ca and the like can be inevitably mixed in the main phase.

A main phase of the R-T-B based sintered magnet according to the present embodiment is $R_2T_{14}B$ crystal grains, similarly with the main phase of the R-T-B based sintered magnet according to the above first embodiment; and said $R_2T_{14}B$ crystal grains have a crystal structure comprising $R_2T_{14}B$ type tetragonal. An average particle diameter of the $R_2T_{14}B$ crystal grains is generally 1 to 30 μm or so, similarly with the main phase of the R-T-B based sintered magnet according to the above first embodiment.

A grain boundary of the R-T-B based sintered magnet according to the present embodiment comprises an R-rich phase, wherein "R" content is higher than that in the R—O—C—N concentrated part or in the $R_2T_{14}B$ crystal grains. B-rich phase, wherein a compound ratio of boron (B) atom is high, may be included in the grain boundary other than said R-rich phase.

Content of "R" in the R-T-B based sintered magnet according to the present embodiment is the same with a content of "R" of $R_2T_{14}B$ compound included in a main phase of R-T-B based sintered magnet according to the above first embodiment, and its description will be abbreviated.

"B" represents "B" or "B and C". Content of "B" in the R-T-B based sintered magnet according to the present embodiment is the same with a content of "B" of $R_2T_{14}B$ compound included in a main phase of R-T-B based sintered magnet according to the above first embodiment, and its description will be abbreviated.

"T" represents one or more kinds of transition metal elements including Fe or Fe and Co, as mentioned above. "T" may be Fe alone, or Fe partly substituted by Co. Fe content in the R-T-B based sintered magnet according to the present embodiment is the same with a content of "T" of $R_2T_{14}B$ compound included in a main phase of R-T-B based sintered magnet according to the above first embodiment, and its description will be abbreviated. When Fe is partly substituted by Co to include said Co, Co content is the same with that in a main phase of R-T-B based sintered magnet according to the above first embodiment, and its description will be abbreviated. Ti, V, Cr, Mn, Ni, Cu, Zr, Nb, Mo, Hf, Ta, W and the like are exemplified as transition metal elements, other than Fe or Fe and Co, similarly with the main phase of R-T-B based sintered magnet according to the above first embodiment. In addition, "T" may further include at least one kind of element such as Al, Ga, Si, Bi, Sn and the like, other than transition metal elements, similarly with the main phase of R-T-B based sintered magnet according to the above first embodiment.

When including either or both of Al and Cu, a content of said either or both of Al and Cu in the R-T-B based sintered magnet according to the present embodiment is preferably 0.02 wt % or more to 0.6 wt % or less, similarly with the main phase of R-T-B based sintered magnet according to the above first embodiment. Al and Cu contents are the same with those in the main phase of R-T-B based sintered magnet according to the above first embodiment, and overlapping description will be abbreviated.

A certain amount of oxygen (O) should be included in the R-T-B based sintered magnet according to the present embodiment, similarly with the R-T-B based sintered magnet according to the above first embodiment. Said certain amount is varied according to the other parameters, and is suitably determined. The amount of oxygen is preferably 500 ppm or more considering a corrosion resistance, and it is preferably 2000 ppm or less considering magnetic properties, similarly with the R-T-B based sintered magnet according to the above first embodiment.

In addition, an amount of carbon (C) in the R-T-B based sintered magnet according to the present embodiment is varied according to the other parameters, and is suitably determined. Magnetic properties deteriorate when carbon amount increases, while the R—O—C—N concentrated part is not formed when said carbon amount is less. Thus, carbon amount is preferably 400 ppm or more to 3000 ppm or less, more preferably 400 ppm or more to 2500 ppm or less, and the most preferably 400 ppm or more to 2000 ppm or less.

In addition, an amount of nitrogen (N) in the R-T-B based sintered magnet according to the present embodiment is varied according to the other parameters, and is suitably determined. Magnetic properties deteriorate when nitrogen amount increases, while the R—O—C—N concentrated part is not formed when said nitrogen amount is less. Thus, nitrogen amount is preferably 100 ppm or more to 1200 ppm or less, more preferably 200 ppm or more to 1000 ppm or less, and the most preferably 300 ppm or more to 800 ppm or less.

A measurement method of oxygen amount, carbon amount and nitrogen amount in the R-T-B based sintered magnet is the same with that in the R-T-B based sintered magnet according to the above first embodiment, and its description will be abbreviated.

The R-T-B based sintered magnet according to the present embodiment comprises an R—O—C—N concentrated part, wherein concentrations of "R", "O", "C" and "N" are higher than those in $R_2T_{14}B$ crystal grains, respectively, in its grain boundary. Note that, although the R—O—C—N concentrated part is mainly composed of "R", "O", "C" and "N" as described above, the other components may be included.

Figure 4:
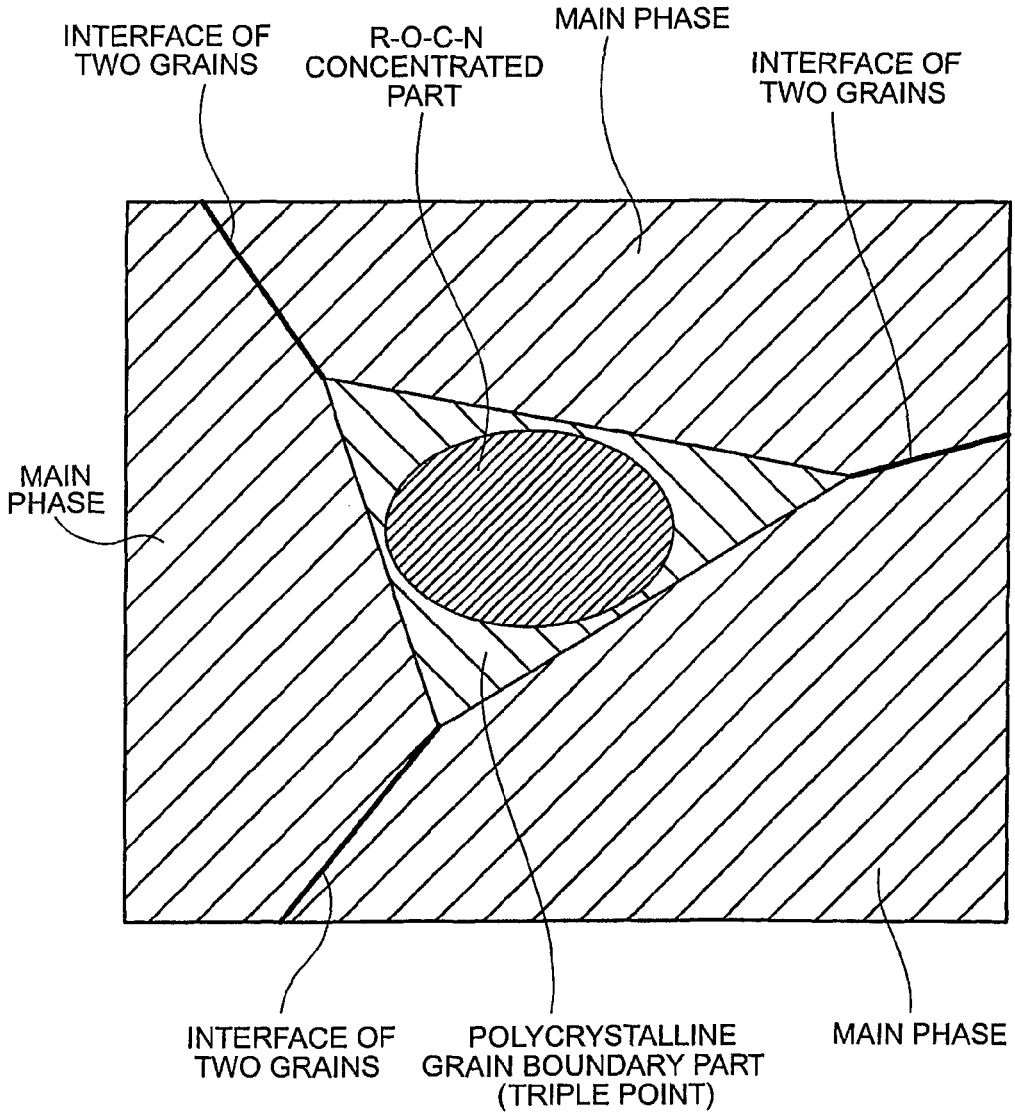
FIG. 4 is a schematic diagram showing a grain boundary formed by a plural number of $R_2T_{14}B$ crystal grains of the R-T-B based sintered magnet according to the second embodiment of the present invention.

FIG. 4 is a schematic diagram showing a grain boundary formed by a plural number of $R_2T_{14}B$ crystal grains of the R-T-B based sintered magnet according to the present embodiment. As shown in FIG. 4, the R—O—C—N concentrated part is formed in a grain boundary of the R-T-B based sintered magnet according to the present embodiment.

In the R-T-B based sintered magnet according to the present embodiment, an area of the R—O—C—N concentrated part occupying in that of a grain boundary in an arbitrary cut surface of the R-T-B based sintered magnet is within a range of 10% or more to 75% or less. Note that said arbitrary cut surface according to the present embodiment is a cross-section cut parallel to an axis of easy magnetization of the R-T-B based sintered magnet, similarly with the R-T-B based sintered magnet according to the above first embodiment. In a case when an area of the R—O—C—N concentrated part occupying in that of a grain boundary in an arbitrary cut surface of the R-T-B based sintered magnet is 10% or less, storage of hydrogen, produced by a corrosion reaction due to water such as water vapor in used environment, in a grain boundary cannot be sufficiently prevented, and a corrosion resistance of the R-T-B based sintered magnet according to the present embodiment is deteriorated. On the other hand, in case when an area of the R—O—C—N concentrated part occupying in that of a grain boundary in an arbitrary cut surface of the R-T-B based sintered magnet exceeds 75%, an R-rich phase required for an expression of coercivity HcJ in a grain boundary (an interface of two grains) formed by two $R_2T_{14}B$ crystal grains become insufficient, and coercivity HcJ of the R-T-B based sintered magnet according to the present embodiment is deteriorated. Considering above, by setting an area of the R—O—C—N concentrated part occupying in that of a grain boundary in an arbitrary cut surface of the R-T-B based sintered magnet within the above range, it effectively prevents a storage of hydrogen, generated by a reaction of water, such as water vapor in used environment invading inside the R-T-B based sintered magnet, and "R" in the R-T-B based sintered magnet. And thus, corrosion progress to the inner side of the R-T-B based sintered magnet can be prevented, as well as good magnetic properties can be obtained.

In the R-T-B based sintered magnet according to the present embodiment, an area of the R—O—C—N concentrated part occupying in that of a grain boundary in an arbitrary cut surface of the R-T-B based sintered magnet is preferably within a range of 35% or more to 75% or less. By setting an area of the R—O—C—N concentrated part occupying in that of a grain boundary in an arbitrary cut surface of the R-T-B based sintered magnet within the above range, it effectively prevents a storage of hydrogen, generated by a corrosion reaction of water, invading inside the R-T-B based sintered magnet, and "R" in the R-T-B based sintered magnet. Therefore, further progress of corrosion inside the R-T-B based sintered magnet can be prevented; and thus, corrosion resistance of the R-T-B based sintered magnet according to the present embodiment can further be improved as well as the R-T-B based sintered magnet according to the present embodiment shows good magnetic properties.

Due to a storage of hydrogen, produced by a corrosion reaction of water, such as water vapor in used environment, and "R" in the R-T-B based sintered magnet, in an R-rich phase present in a grain boundary of the R-T-B based sintered magnet, corrosion of the R-T-B based sintered magnet progresses inside the R-T-B based sintered magnet at an accelerated pace.

Namely, corrosion of the R-T-B based sintered magnet is produced by the following, similarly with that of the R-T-B based sintered magnet described in the above first embodiment. Corrosion of the R-T-B based sintered magnet progresses inside the R-T-B based sintered magnet by the above chain reactions (I) to (III); and an R-rich phase changes to an R hydroxide and to an R hydride. Stress is accumulated by a volume expansion associated with this change, which leads to a falling of crystal grain (a main phase grain) constituting a main phase of the R-T-B based sintered magnet. And then, a newly formed surface of the R-T-B based sintered magnet emerges due to the falling of crystal grain of the main phase, which leads to further progress of R-T-B based sintered magnet corrosion inside the R-T-B based sintered magnet.

Considering above, in the R-T-B based sintered magnet according to the present embodiment, an area of the R—O—C—N concentrated part occupying in that of a grain boundary in an arbitrary cut surface of the R-T-B based sintered magnet is set within a range of 10% or more to 75% or less. The R—O—C—N concentrated part is difficult to store hydrogen. Therefore, due to a predetermined amount of the R—O—C—N concentrated part formed in a grain boundary of an arbitrary cut surface of the R-T-B based sintered magnet, hydrogen produced by a corrosion reaction is prevented to be stored in an inner part of an R-rich phase; and thus, inner progress of corrosion by the above processes can be prevented. In addition, R—O—C—N concentrated part is difficult to be oxidized in relative to an R-rich phase, and that hydrogen production itself due to the corrosion can also be prevented. Therefore, according to the R-T-B based sintered magnet of the present embodiment, corrosion resistance of the R-T-B based sintered magnet can be improved to a large extent, showing good magnetic properties.

In addition, in an R—O—C—N concentrated part in a grain boundary of R-T-B based sintered magnet according to the present embodiment, a ratio (O/R) of O atom to R atom in the above R—O—C—N concentrated part preferably satisfies the following formula (1)'. Namely, (O/R) is preferably smaller than a stoichiometric ratio composition of R oxides ($R_2O_3$, $RO_2$, RO and the like). Due to a presence of R—O—C—N concentrated part having a predetermined range of (O/R) in its grain boundary, hydrogen, produced by a corrosion reaction of water and "R" in the R-T-B based sintered magnet, is effectively prevented to be stored in an inner R-rich phase; and corrosion progress to the inner side of the R-T-B based sintered magnet can be prevented as well as the R-T-B based sintered magnet of the present embodiment is able to show good magnetic properties.

$$0<(O/R)<1 \quad (1)'$$

Further, said (O/R) is preferable to satisfy the following formula (2)'. In case when (O/R) is less than 0.4, a storage of hydrogen, produced by a corrosion reaction of water and "R" in the R-T-B based sintered magnet, cannot be sufficiently prevented; and corrosion resistance of the R-T-B based sintered magnet tends to deteriorate. While when (O/R) is more than 0.7, consistency with its main phase grain become worse and coercivity HcJ tends to be deteriorated.

$$0.4<(O/R)<0.7 \quad (2)'$$

(O/R) is further preferable to satisfy the following formula (3)'. By setting (O/R) within the following formula (3)', corrosion resistance of R-T-B based sintered magnet can be further improved.

$$0.5<(O/R)<0.7 \quad (3)'$$

In addition, in an R—O—C—N concentrated part in a grain boundary of R-T-B based sintered magnet according to the present embodiment, a ratio (N/R) of N atom to R atom in the above R—O—C—N concentrated part preferably satisfies the following formula (4)'. Namely, (N/R) is preferably smaller than a stoichiometric ratio composition of R nitrides (RN and the like). Note that a ratio of N atom to R atom is described as (N/R) in this specification. Due to a presence of R—O—C—N concentrated part having a predetermined range of (N/R) in its grain boundary, hydrogen, produced by a corrosion reaction of water and "R" in the R-T-B based sintered magnet, is effectively prevented to be stored in an inner R-rich phase; and corrosion progress to the inner side of the R-T-B based sintered magnet can be prevented as well as the R-T-B based sintered magnet of the present embodiment is able to show good magnetic properties.

$$0<(N/R)<1 \quad (4)'$$

Further, the R—O—C—N concentrated part is preferable to comprise a cubic crystal structure. Further storage of hydrogen in a grain boundary can be prevented due to the inclusion of said cubic crystal structure; and corrosion resistance of the R-T-B based sintered magnet according to the present embodiment can be improved.

"R" included in the R—O—C—N concentrated part preferably includes RL (a rare earth element at least includes either or both of Nd and Pr) and RH (a rare earth element at least includes either or both of Dy and Tb). An excellent corrosion resistance will be shown and its magnetic properties can be further improved, due to the inclusion of RL and RH in the R—O—C—N concentrated part.

As mentioned below, the R-T-B based sintered magnet according to the present embodiment can be manufactured by adding a predetermined amount of raw materials, which are an oxygen source and a carbon source different from the R-T-B based raw material alloy, to the R-T-B based raw material alloy, and by controlling manufacturing conditions such as an oxygen and nitrogen concentrations in an atmosphere of production processes.

Powders including an oxide of element "M", wherein a standard producing free energy of its oxide is higher than that of a rare earth element oxide, can be used for an oxygen source of the R—O—C—N concentrated part. A carbide of an element "M'", wherein a standard producing free energy of its carbide is higher than that of a rare earth element carbide, powders including carbon such as graphite, carbon black and the like, and an organic compound which produces carbon by a thermal decomposition can be used for a carbon source of the R—O—C—N concentrated part. In addition, surface oxidized metal particles can be used as the oxygen source, and metal particles including carbide such as cast iron can be used as the carbon source.

The R—O—C—N concentrated part formed in a grain boundary of the R-T-B based sintered magnet according to the present embodiment is produced by the following method. Namely, M oxide included in the added oxygen source has higher standard producing free energy relative to that of an oxide of rare earth element "R". Therefore, when manufacturing a sintered body by adding an oxygen source and a carbon source to R-T-B based raw material alloy and sintering the same, the M oxide is reduced by R-rich liquid phase generated during said sintering; and M metal and "O" are produced. Further, when adding M' (standard producing free energy of its carbide is higher than that of a rare earth element carbide) carbide as a carbon source, M' metal and "C" are produced likewise. These M metal and M' metal are stored in a $R_2T_{14}B$ crystal or an R-rich phase. On the other hand, "O" and "C" react with a part of an R-rich phase together with "N" added to control a nitrogen concentration during the manufacturing process and deposit as R—O—C—N concentrated part in a grain boundary, a polycrystalline grain boundary part in particular.

With the conventional R-T-B based sintered magnet, "O" is included as an inevitable impurity such as by an oxidization of raw material powders when pressing in an atmosphere. However, "O" included at this time is in a form of R oxide due to an oxidization of rare earth element "R" in raw material powders; and that it is considered not to be reduced during sintering process and deposit in a grain boundary in a form of R oxide, an unchanged form.

On the other hand, during manufacturing process of the R-T-B based sintered magnet according to the present embodiment, formation of R oxide is controlled by performing each process of pulverization, pressing and sintering of a raw material alloy in an extremely low oxygen concentration (e.g. around 100 ppm or less) atmosphere. Thus, "O" generated by an reduction of M oxide during sintering process, "C" added as a carbon source and "N" added to control a nitrogen concentration during the manufacturing process are considered to deposit in a grain boundary in a form of R—O—C—N concentrated part. Namely, R oxide deposit in a grain boundary with a conventional method, while according to a method of the present embodiment, predetermined amount of R—O—C—N concentrated part is possible to deposit while controlling a formation of R oxides in grain boundary.

Further, other than the R—O—C—N concentrated part, R—C concentrated area, wherein R concentration and C concentration are higher than those of $R_2T_{14}B$ crystal grains, R—O concentrated area (including R oxide), wherein R concentration and O concentration are higher than those of $R_2T_{14}B$ crystal grains, and the like are included in a grain boundary, similarly with the R-T-B based sintered magnet according to the above first embodiment. In addition, other than above, an R-rich phase, wherein R concentration is higher than that of $R_2T_{14}B$ crystal grains, is present. Although a certain amount of said R-rich phase is required for an expression of coercivity HcJ, R—C concentrated area and R—O concentrated area are preferable to be less. For instance, the R—C concentrated area is preferable to be 30% or less of the grain boundary area, and R—O concentrated area is preferable to be 10% or less of the grain boundary area. This is due to a fact that an excess of said R—C concentrated area tends to decrease corrosion resistance of R-T-B based sintered magnet, and an excess of R—O concentrated area tends to decrease residual magnetic flux density Br of R-T-B based sintered magnet.

Therefore, the R-T-B based sintered magnet according to the present embodiment is a magnet wherein a predetermined amount of R—O—C—N concentrated part is formed in its grain boundary. By setting an area of the R—O—C—N concentrated part occupying in that of a grain boundary in an arbitrary cut surface of the R-T-B based sintered magnet within a predetermined range, hydrogen storage in a grain boundary can be prevented and progress of R corrosion inside the magnet can be prevented. And thus, R-T-B based sintered magnet according to the present embodiment comprises an excellent corrosion resistance, as well as good magnetic properties.

Further, the R-T-B based sintered magnet according to the present embodiment is generally used after shaping in an arbitrary form, similarly with the R-T-B based sintered magnet according to the above first embodiment.

The R-T-B based sintered magnet according to the present embodiment include both a magnet product magnetized after machining the present magnet and a magnet product of the present magnet which is unmagnetized, similarly with the R-T-B based sintered magnet according to the above first embodiment.

<Manufacturing Method of the R-T-B Based Sintered Magnet>

Figure 5:
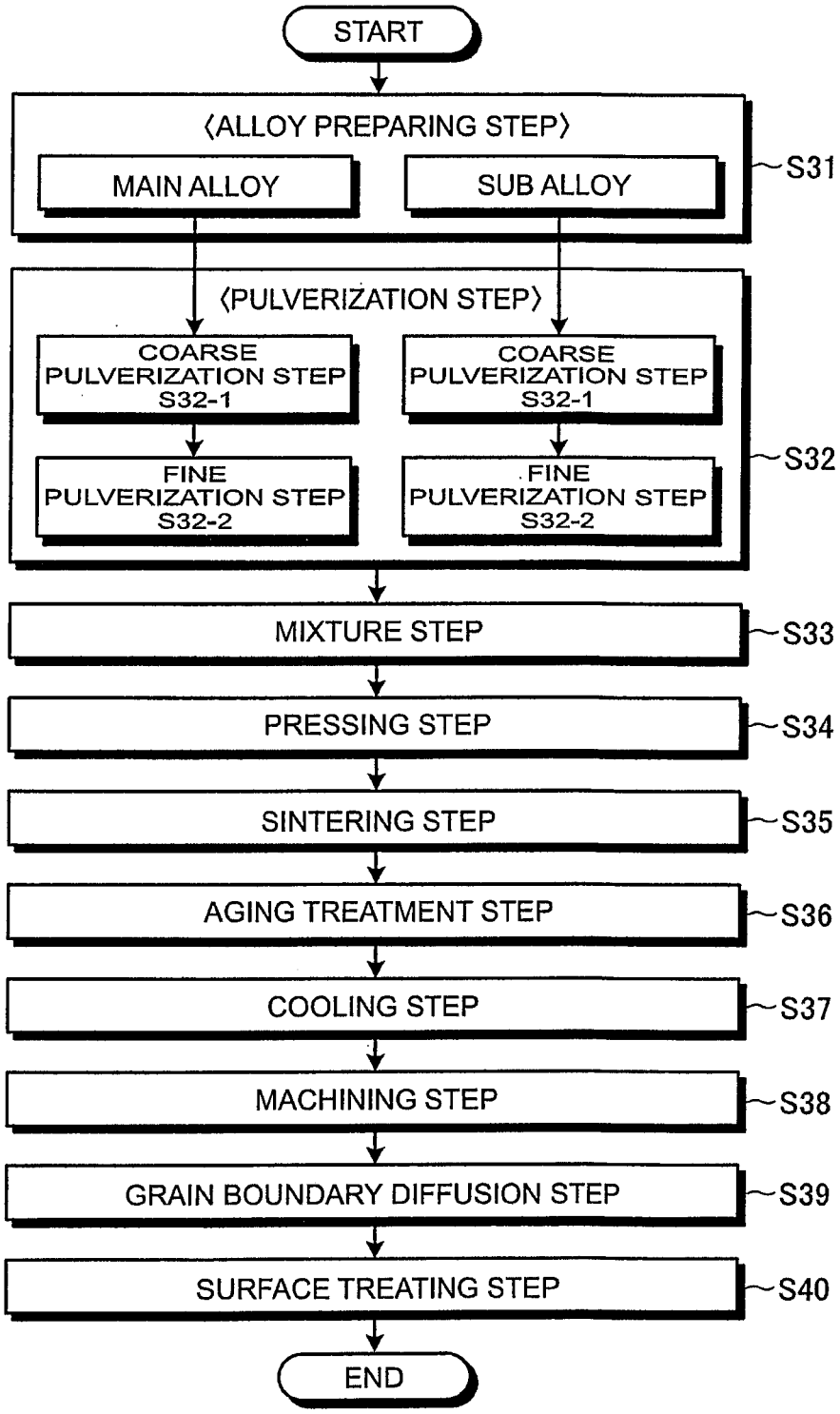
FIG. 5 is a flow chart showing an example of a production method of the R-T-B based sintered magnet according to the second embodiment of the present invention.

An example of manufacturing method of the R-T-B based sintered magnet according to the present embodiment comprising the above structures is described referring to drawings. FIG. 5 is a flow chart indicating an example of manufacturing method of R-T-B based sintered magnet according to an embodiment of the present invention. As shown in FIG. 5, a manufacturing method of the R-T-B based sintered magnet according to the present embodiment comprises the following steps.

(a) Alloy preparing step wherein a main alloy and a sub alloy are prepared (Step S31).
(b) Pulverization step wherein the main alloy and the sub alloy are pulverized (Step S32).
(c) Mixture step wherein a main alloy powder and a sub alloy powder are mixed (Step S33).
(d) Pressing step wherein the mixed powder is pressed (Step S34).
(e) Sintering step wherein the green compact is sintered and an R-T-B based sintered magnet is obtained (Step S35).
(f) Aging treatment step wherein the R-T-B based sintered magnet is age treated (Step S36).
(g) Cooling step wherein the R-T-B based sintered magnet is cooled (Step S37).
(h) Machining step wherein the R-T-B based sintered magnet is machined (Step S38).
(i) Grain boundary diffusion step wherein a heavy rare earth element is diffused in a grain boundary of the R-T-B based sintered magnet (Step S39).
(j) Surface treating step wherein the R-T-B based sintered magnet is surface treated (Step S40).

[Alloy Preparing Step: Step S31]

An alloy having a composition constituting a main phase (a main alloy) and the same constituting a grain boundary (a sub alloy) are prepared (an alloy preparing step (Step S31)). This alloy preparing step (Step S31) is the same with "an alloy preparing step (Step S11)" of a manufacturing method of the R-T-B based sintered magnet according to the above first embodiment, and the description is omitted.

[Pulverization Step: Step S32]

After the main alloy and the sub alloy are manufactured, said main alloy and said sub alloy are pulverized (a pulverization step (Step S32)). According to this pulverization step (Step S32), similarly with the pulverization step (Step S12) of the R-T-B based sintered magnet manufacturing method according to the above first embodiment, after the main alloy and the sub alloy are manufactured, said main alloy and said sub alloy are separately pulverized to make powders. Note that, although these main alloy and sub alloy may be pulverized together, these are preferably separately pulverized in view of suppressing their composition deviation.

A pulverization step (Step S32) includes a coarse pulverization step (Step S32-1), pulverized until a particle diameter is approximately a several hundred μm to a several mm, and a fine pulverization step (Step S32-2), pulverized until a particle diameter is approximately a several hundred μm, similarly with the pulverization step (Step S12) of the R-T-B based sintered magnet manufacturing method according to the above first embodiment.

(Coarse Pulverization Step (Step S32-1))

A main alloy and a sub alloy are coarsely pulverized until each particle diameter is approximately a several hundred μm to a several mm (Coarse pulverization step (Step S32-1)). Coarse pulverized powders of the main alloy and the same of the sub alloy are thus obtained. The coarse pulverization is performed by the following steps. Hydrogen is stored in the main alloy and the sub alloy, and then said hydrogen is emitted. And with this dehydrogenation, pulverization of a self-collapsed type (a hydrogen storage pulverization) is able to be generated on the basis of a difference of capable hydrogen storage amount among the phases. An additive amount of nitrogen required for forming R—O—C—N phase can be controlled by adjusting this nitrogen gas concentration of an atmosphere during the dehydrogenation treatment in this hydrogen storage pulverization. Although an optimum nitrogen gas concentration varies according to a composition of a raw material alloy and the like, it is preferably 200 ppm or more, for instance. Further, the coarse pulverization step (Step S32-1) can be performed by using a coarse pulverizer such as a stamp mill, a jaw crusher, a brown mill and the like, in an inert gas atmosphere, other than using the above-mentioned hydrogen storage pulverization, similarly with the coarse pulverization step (Step S12-1) of the R-T-B based sintered magnet manufacturing method according to the above first embodiment.

Further, an atmosphere of each step, from a pulverization step (Step S32) to a sintering step (Step S35), is preferable to control to have a low oxygen concentration, similarly with the coarse pulverization step (Step S12-1) of the R-T-B based sintered magnet manufacturing method according to the above first embodiment. The low oxygen concentration adjustment method is the same with that in the manufacturing method of the R-T-B based sintered magnet according to the above first embodiment, thus the description is omitted.

(Fine Pulverization Step: Step S32-2)

After a coarse pulverization of the main alloy and the sub alloy, the obtained coarse pulverized powders of said main alloy and said sub alloy are finely pulverized till their average particle diameter is approximately several μm, similarly with the coarse pulverization step (Step S12-1) of the R-T-B based sintered magnet manufacturing method according to the above first embodiment (a fine pulverization step (Step S32-2)). Fine pulverized powders of a main alloy and a sub alloy are then obtained. Fine pulverized powders having a particle diameter of preferably 1 μm or more to 10 μm or less, more preferably 3 μm or more to 5 μm or less can be obtained by further finely pulverizing the coarse pulverized powders.

Note that, although the fine pulverized powders are obtained by separately pulverizing the main alloy and the sub alloy in the present embodiment, said fine pulverized powder may be obtained after mixing the coarse pulverized powder of the main alloy and that of the sub alloy in a fine pulverization step (Step S32-2), similarly with the R-T-B based sintered magnet manufacturing method according to the above first embodiment.

The fine pulverization is the same the fine pulverization step (Step S12-2 of the R-T-B based sintered magnet manufacturing method according to the above first embodiment, thus the description is omitted.

Addition of pulverization aids, such as zinc stearate, oleic amide and the like, when finely pulverizing the coarse pulverized powders of a main alloy and a sub alloy allows to obtain fine pulverized powders which enable high orientation at pressing, similarly with the fine pulverization step (Step S12-2) in R-T-B based sintered magnet manufacturing method according to the above first embodiment.

[Mixture Step: Step S33]

After the fine pulverization of the main alloy and the sub alloy, each fine pulverized powders are mixed in a low oxygen atmosphere (a mixture step (Step S33)). A mixed powder is then obtained. A mixture step (Step S33) is the same with the mixture step (Step S13) in a manufacturing method of the R-T-B based sintered magnet according to the above first embodiment. A low oxygen atmosphere is an inert gas atmosphere such as $N_2$ gas, Ar gas atmosphere and the like. Compounding ratio of the main alloy powder and the sub alloy powder is preferably 80/20 or more to 97/3 or less in weight ratio, more preferably 90/10 or more to 97/3 or less in weight ratio.

Further, in the pulverization step (Step S32), a compounding ratio of the main alloy and the sub alloy when pulverized together can be the same with a compounding ratio of the main alloy and the sub alloy when pulverized separately. Said compounding ratio of the main alloy and the sub alloy is preferably 80/20 or more to 97/3 or less in weight ratio, more preferably 90/10 or more to 97/3 or less in weight ratio.

An oxygen source and a carbon source, different from a raw material alloy, are added to the mixed powder. In case when a predetermined amount of an oxygen source and a carbon source, different from a raw material alloy, are added to the mixed powder, an R—O—C—N concentrated part in object is formed in a grain boundary, formed by adjacent two or more $R_2T_{14}B$ crystal grains of the obtained R-T-B based sintered magnet Powders including an oxide of element "M", wherein a standard producing free energy of its oxide is higher than that of a rare earth element oxide, can be used as an oxygen source. Although Al, Fe, Co, Zr and the like can be exemplified as "M" in concrete, it is not limited thereto. In addition, surface oxidized metal particles may be used.

A carbide of an element "M'", wherein a standard producing free energy of its carbide is higher than that of a rare earth element carbide, powders including carbon such as graphite, carbon black and the like, and an organic compound which produces carbon by a thermal decomposition or so can be used for the carbon source. Although Si, Fe and the like can be exemplified as "M'" in concrete, it is not limited thereto. In addition, a powder including a carbide such as cast iron may be used.

An appropriate additive amount of the oxygen source and the carbon source varies according to a composition of a raw material alloy, in particular, to an amount of rare earth.

Therefore, in order to form an area ratio of the R—O—C—N concentrated part in object according to a composition of the used alloy, an additive amount of the oxygen source and the carbon source is adjusted. An excess of the required additive amount of the oxygen source and the carbon source leads to an excessive increase of R—O—C—N concentrated part area. Thus, it tends to decrease HcJ of the obtained R-T-B based sintered magnet, and there is a tendency that sufficient corrosion resistance cannot be obtained by forming R—O concentrated area, R—C concentrated area and the like. While, a predetermined area of R—O—C—N concentrated part cannot be obtained with too little of the required additive amount of the oxygen source and the carbon source.

Although an adding method of the oxygen source and the carbon source is not particularly limited, it is preferable to add when mixing fine pulverized powder, or to add to a coarse pulverized powder before fine pulverization.

Further, although nitrogen is added to control nitrogen gas concentration in an atmosphere during dehydrogenation treatment in a coarse pulverization step according to the present embodiment, a powder including a nitride of an element "M'''", wherein a standard producing free energy of its nitride is higher than that of a rare earth element nitride, may be added as a nitrogen source instead. Although Si, Fe, B and the like are exemplified as "M'''" in concrete, it is not limited thereto.

[Pressing Step: Step S34]

After mixing the main alloy powder and the sub alloy powder, a mixed powder is pressed to an objective form (a pressing step (Step S34)). Thus, a green compact is obtained. The pressing step (Step S34) is the same with the pressing step (Step S14) in a manufacturing method of the R-T-B based sintered magnet according to the above first embodiment, and the description is omitted. The obtained green compact is oriented to a particular direction, and that an anisotropy R-T-B based sintered magnet with more strong magnetism can be obtained.

[Sintering Step: Step S35]

A green compact, obtained by pressing to an objective shape in a magnetic field, is sintered in a vacuum or an inert gas atmosphere; and R-T-B based sintered magnet is obtained (a sintering step (Step S35)). The sintering step (Step S35) is the same with the sintering step (Step S15) in a manufacturing method of R-T-B based sintered magnet according to the above first embodiment, and the description is omitted. Thus, a mixed powder produces a liquid phase sintering, and then an R-T-B based sintered magnet (a sintered body of R-T-B based sintered magnet) wherein a volume ratio of main phase is increased can be obtained.

[Aging Treatment Step: Step S36]

After sintering the green compact, the R-T-B based sintered magnet is age treated (an aging treatment step (Step S36)). After sintering, an aging treatment is performed to the R-T-B based sintered magnet, such as by holding the obtained R-T-B based sintered magnet in a temperature that is lower than a sintering temperature. The aging treatment step (Step S36) is the same with the above aging treatment step (Step S16) in a manufacturing method of the R-T-B based sintered magnet according to the above first embodiment, and the description is omitted. Such aging treatment can improve magnetic properties of the R-T-B based sintered magnet. In addition, an aging treatment step (Step S36) can be performed after a machining step (Step S38) or a grain boundary diffusion step (Step S39).

[Cooling Step: Step S37]

After an aging treatment is performed to the R-T-B based sintered magnet, said R-T-B based sintered magnet is rapidly cooled in Ar gas atmosphere (a cooling step (Step S37)). A cooling step (Step S37) is the same with the cooling step (Step S17) in a manufacturing method of the R-T-B based sintered magnet according to the above first embodiment, and the description is omitted. The R-T-B based sintered magnet according to the present embodiment is thus obtained.

[Machining Step: Step S38]

The obtained R-T-B based sintered magnet may be machined to a desired shape when required (a machining step: Step S38). The machining step (Step S38) is the same with the machining step (Step S18) in a manufacturing method of the R-T-B based sintered magnet according to the above first embodiment, and the description is omitted.

[Grain Boundary Diffusion Step: Step S39]

A step wherein heavy rare earth element is further diffused in a grain boundary of the machined R-T-B based sintered magnet may be performed (a grain boundary diffusion step: Step S39). The grain boundary diffusion step (Step S39) is the same with the grain boundary diffusion step (Step S19) in a manufacturing method of the R-T-B based sintered magnet according to the above first embodiment, and the description is omitted. With this step, coercivity HcJ of the R-T-B based sintered magnet can be further improved.

[Surface Treating Step: Step S40]

A surface treatment, such as plating, resin coating, oxidize treatment, chemical conversion treatment and the like, can be performed to the R-T-B based sintered magnet obtained by the above steps (a surface treating step (Step S40)), similarly with the surface treating step (Step S20) of the R-T-B based sintered magnet according to the above first embodiment. Thus, a corrosion resistance can be further improved.

Note that, although a machining step (Step S38), a grain boundary diffusion step (Step S39) and a surface treating step (Step S40) are performed in the present embodiment, these steps are not necessary performed.

As mentioned above, the R-T-B based sintered magnet according to the present embodiment is manufactured as above, finishing all the treatments. In addition, a magnet product can be obtained by magnetizing thereof.

Thus obtained R-T-B based sintered magnet according to the present embodiment comprises R—O—C—N concentrated part in its grain boundary, and an area of the R—O—C—N concentrated part occupying in that of a grain boundary on a cut surface of the R-T-B based sintered magnet is within a range of 10% or more to 75% or less. The R-T-B based sintered magnet according to the present embodiment shows an excellent corrosion resistance, as well as good magnetic properties, by having a predetermined amount of R—O—C—N concentrated part in its grain boundary.

In case when used as a magnet for a rotary machine such as motor, thus obtained R-T-B based sintered magnet according to the present embodiment can be used over a long term due to its high corrosion resistance, providing a high reliable R-T-B based sintered magnet. The R-T-B based sintered magnet according to the present embodiment can be preferably used as a magnet of surface magnet type (Surface Permanent Magnet: SPM) motor wherein a magnet is attached on the surface of a rotor, an interior magnet embedded type (Interior Permanent Magnet: IPM) motor such as inner rotor type brushless motor, PRM (Permanent magnet Reluctance Motor) and the like. In concrete, the R-T-B based sintered magnet according to the present embodiment is preferably used for a spindle motor for a hard disk rotary drive or a voice coil motor of a hard disk drive, a motor for an electric vehicle or a hybrid car, an electric power steering motor for an automobile, a servo motor for a machine tool, a motor for vibrator of a cellular phone, a motor for a printer, a motor for a magnet generator and the like.

The R-T-B based sintered magnet according to the present embodiment can be used as a permanent magnet 16 of SPM motor 10 as shown in FIG. 3, similarly with the R-T-B based sintered magnet according to the above first embodiment. The permanent magnet 16 shows corrosion resistance while showing high magnetic properties. SPM motor 10 is thus capable of improving motor characteristics, such as a torque characteristic, and showing a high output for a long term; and that said SPM motor 10 is excellent in reliability.

Although preferable embodiments of the R-T-B based sintered magnet according to the present invention are described in the above first and second embodiments hereinbefore, said R-T-B based sintered magnet according to the present invention is not limited thereto. Various changes and various combinations of the R-T-B based sintered magnet according to the present invention are possible, without departing from the scope of the invention; and similarly, it can be applied to the other rare earth magnet.

EXAMPLES

Hereinafter, although the invention will be described in detail referring to the examples and the comparative examples, the present invention is not limited to said examples.

Example 1

Manufacturing R-T-B Based Sintered Magnet

Ex. 1-1 to Ex. 1-6, Comp. Ex. 1-1

To obtain sintered magnets having a composition of 21.20 wt % Nd—2.50 wt % Dy—7.20 wt % Pr—0.50 wt % Co—0.20 wt % Al—0.05 wt % Cu—1.00 wt % B—bal. Fe, an alloy for a sintered body (a raw material alloy) having the above composition was manufactured by a strip casting (SC) method at first. Two kinds, a main alloy, mainly forming a main phase of a magnet, and a sub alloy, mainly forming a grain boundary, were manufactured as the raw material alloy.

A hydrogen pulverization (a coarse pulverization) was then performed to the raw material alloy by storing hydrogen in each of the raw material alloy at a room temperature, and then by dehydrogenating thereof at 600° C. for an hour. Note, in each example and comparative example, an oxygen concentration atmosphere during each step (a fine pulverization and a pressing) from hydrogen pulverization treatment to sintering was less than 50 ppm.

Next, after the hydrogen pulverization and before a fine pulverization, 0.1 wt % of oleic amide was added to the coarse pulverized powder of each raw material alloy as a pulverization aid, and then mixed by Nauta Mixer. And then, a fine pulverization was performed by a high pressure $N_2$ gas using a jet mill, obtaining a fine pulverized powder having an average particle diameter of around 4.0 μm.

Subsequently, the obtained fine pulverized powder of the main alloy and that of the sub alloy were mixed in a predetermined ratio, alumina particles as an oxygen source and carbon black particles as a carbon source were each added in an amount shown in Table 1, and mixed thereof using Nauta Mixer preparing a mixed powder of a raw material powder of the R-T-B based sintered magnet.

TABLE 1

| | Alumina particle (wt %) | Carbon black particle (wt %) |
|---|---|---|
| Ex. 1-1 | 0.1 | 0.01 |
| Ex. 1-2 | 0.13 | 0.01 |
| Ex. 1-3 | 0.17 | 0.02 |
| Ex. 1-4 | 0.2 | 0.02 |
| Ex. 1-5 | 0.3 | 0.03 |
| Ex. 1-6 | 0.35 | 0.03 |
| Comp. Ex. 1-1 | 0.4 | 0.03 |

The obtained mixed powders were filled in a press mold placed in an electromagnet, a pressure of 120 MPa was applied while applying a magnetic field of 1200 kA/m, and then a green compact was obtained by pressing in a magnetic field. Subsequently, the obtained green compact was held and sintered in a vacuum at 1060° C. for 4 hours, and then rapidly cooled to obtain a sintered body (the R-T-B based sintered magnet) having the above composition. Next, a two-step aging treatment was performed to the obtained sintered body at 850° C. for an hour and at 540° C. for 2 hours (both in Ar gas atmosphere), and then rapidly cooled to obtain the R-T-B based sintered magnet of Ex. 1-1 to Ex. 1-6 and Comp. Ex. 1-1.

Ex. 1-7

The R-T-B based sintered magnet of Ex. 1-7 was obtained as similar with Ex. 1-1 to Ex. 1-6 and Comp. Ex. 1-1, except 0.33 wt % iron (III) oxide particles as an oxygen source and 0.1 wt % silicon carbide particles as a carbon source were used.

Ex. 1-8

The R-T-B based sintered magnet of Ex. 1-8 was obtained as similar with Ex. 1-1 to Ex. 1-6 and Comp. Ex. 1-1, except 0.38 wt % tricobalt tetroxide particles as an oxygen source and 0.7 wt % cast iron particles including iron carbide as a carbon source were used.

Ex. 1-9

The R-T-B based sintered magnet of Ex. 1-9 was obtained as similar with Ex. 1-1 to Ex. 1-6 and Comp. Ex. 1-1, except 0.6 wt % zirconia particles as an oxygen source and 0.03 wt % graphite particles as a carbon source were used.

Ex. 1-10

The R-T-B based sintered magnet of Ex. 1-10 was obtained as similar with Ex. 1-1 to Ex. 1-6 and Comp. Ex. 1-1, except 0.9 wt % cast iron particles having oxidized surface as oxygen and carbon sources were used.

Ex. 1-11

To obtain a sintered magnet having a composition of 23.25 wt % Nd—7.75 wt % Pr—1.00 wt % Dy—2.50 wt % Co—0.20 wt % Al—0.20 wt % Cu—0.10 wt % Ga—0.30 wt % Zr—0.95 wt % B—bal. Fe, the R-T-B based sintered magnet of Ex. 1-11 was obtained as similar with Ex. 1-4, except an alloy for a sintered body (a raw material alloy) having the above composition was manufactured by the SC method.

Ex. 1-12

To obtain a sintered magnet having a composition of 30.50 wt % Nd—1.50 wt % Co—0.10 wt % Al—0.10 wt % Cu—0.20 wt % Ga—0.92 wt % B—bal. Fe, the R-T-B based sintered magnet of Ex. 1-12 was obtained as similar with Ex. 1-4, except an alloy for a sintered body (a raw material alloy) having the above composition was manufactured by the SC method.

Ex. 1-13

To obtain a sintered magnet having a composition of 25.00 wt % Nd—6.00 wt % Dy—1.00 wt % Co—0.30 wt % Al—0.10 wt % Cu—0.40 wt % Ga—0.15 wt % Zr—0.85 wt % B—bal. Fe, the R-T-B based sintered magnet of Ex. 1-13 was obtained as similar with Ex. 1-4, except an alloy for a sintered body (a raw material alloy) having the above composition was manufactured by the SC method.

Ex. 1-14

After machining the R-T-B based sintered magnet of Ex. 1-4 to have 3 mm thickness, a Dy dispersed slurry was applied to a magnet making a Dy adhered amount with respect to the magnet to 1%. A grain boundary diffusion treatment was performed to the magnet by a heat treatment in Ar atmosphere at 900° C. for 6 hours. An aging treatment at 540° C. for 2 hours was subsequently performed; and an R-T-B based sintered magnet of Ex. 1-14 was obtained. Note the grain boundary diffusion treatment is a treatment wherein a heavy rare earth element, such as Dy, is diffused in a grain boundary of the machined R-T-B based sintered magnet grain boundary, e.g. the grain boundary diffusion step (Step S19) as shown in the above FIG. 2 and the grain boundary diffusion step (Step S39) as shown in the above FIG. 5.

Comp. Ex. 1-2

The R-T-B based sintered magnet of Comp. Ex. 1-2 was obtained as similar with Ex. 1-1 to Ex. 1-6 and Comp. Ex. 1-1, except an oxygen source and a carbon source were not added.

Comp. Ex. 1-3 to Comp. Ex. 1-6

The R-T-B based sintered magnets of Comp. Ex. 1-3 to Comp. Ex. 1-6 were obtained as similar with Ex. 1-11 to Ex. 1-14, except an oxygen source and a carbon source were not added.

<Evaluation>

An structure of the manufactured respective R-T-B based sintered magnet, an amount of oxygen (O amount) and that of carbon (C amount) included in the respective R-T-B based sintered magnet, magnetic properties and corrosion resistances of the respective R-T-B based sintered magnet were measured and evaluated. An area ratio (A/B) of the respective R—O—C concentrated part occupying in grain boundary was obtained as the evaluation of the structure. Residual magnetic flux density Br and coercivity HcJ of the respective R-T-B based sintered magnet were measured as the evaluation of the magnetic properties.

[Structure]

<Observation of an Element Distribution>

Figure 6:
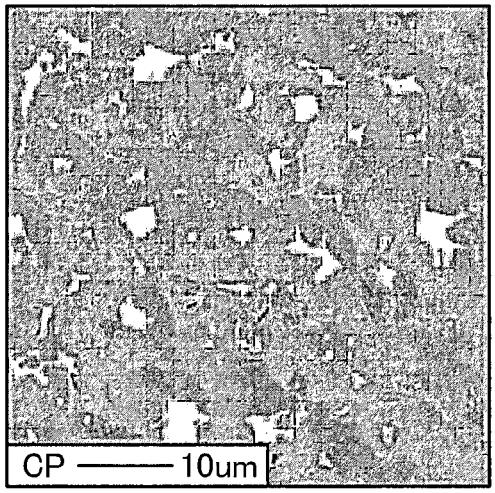
FIG. 6 is a backscattered electron image of the R-T-B based sintered magnet cut surface according to Ex. 1-4.
Figure 7:
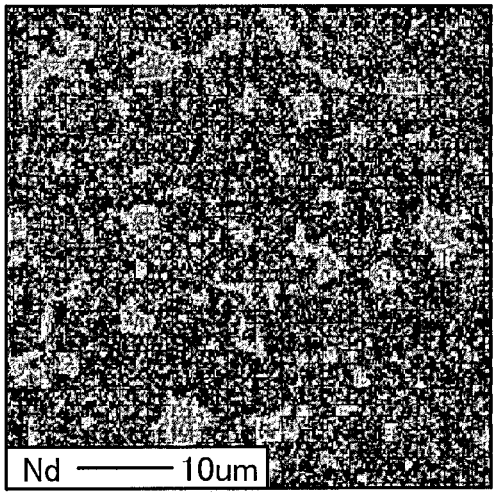
FIG. 7 is a mapping data of Nd in the R-T-B based sintered magnet cut surface according to Ex. 1-4.
Figure 8:
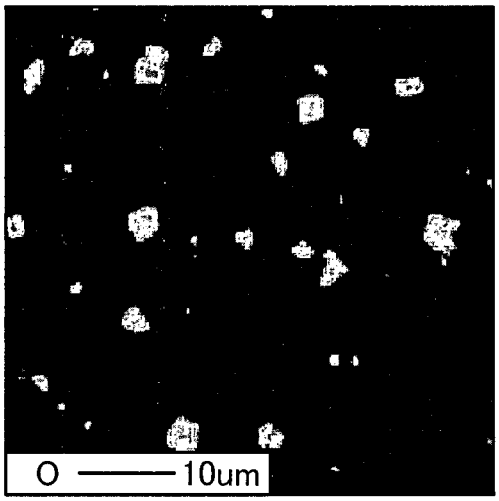
FIG. 8 is a mapping data of O in the R-T-B based sintered magnet cut surface according to Ex. 1-4.
Figure 9:
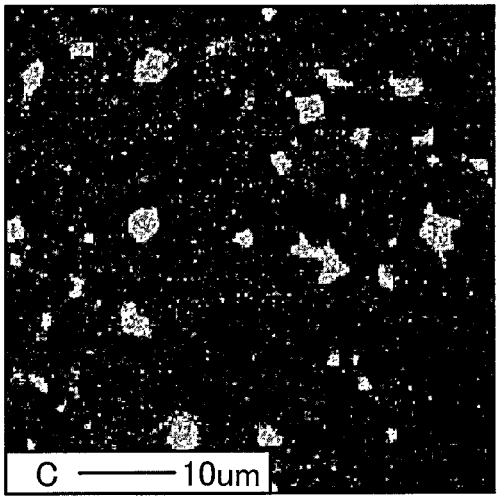
FIG. 9 is a mapping data of C in the R-T-B based sintered magnet cut surface according to Ex. 1-4.
Figure 10:
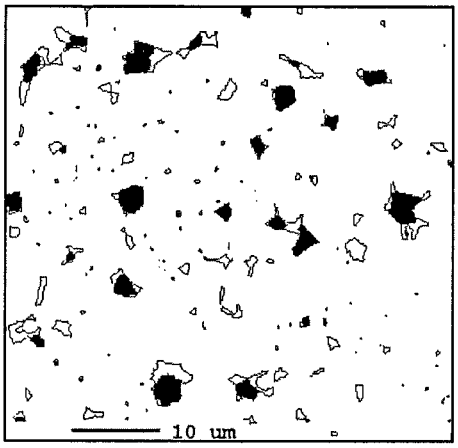
FIG. 10 is a figure showing dispersed areas (an R—O—C concentrated part) wherein a concentration of each element Nd, O and C in the R-T-B based sintered magnet cut surface according to Ex. 1-4 is higher than that of a crystal grain in main phase.

After a surface of a cross-section of the obtained respective R-T-B based sintered magnet was milled by an ion milling removing effects of the outermost surface such as oxidation and the like, an element distribution of the cross-section of the R-T-B based sintered magnet was observed by EPMA (Electron Probe Micro Analyzer) and analyzed thereof. A 50 μm square area of the structure according to the R-T-B based sintered magnet of Ex. 1-4 was observed by EPMA; and then an elemental mapping (256 points×256 points) by EPMA was performed. FIG. 6 is a backscattered electron image of the R-T-B based sintered magnet cut surface of Ex. 1-4. FIGS. 7 to 9 respectively show an observation result of each element Nd, O and C in the R-T-B based sintered magnet cut surface of Ex. 1-4. In addition, an area (an R—O—C concentrated part), wherein a concentration of each element Nd, O and C in the R-T-B based sintered magnet cut surface of Ex. 1-4 is highly distributed than that in a main phase of crystal grain, is shown in FIG. 10.

<Calculation of an Area Ratio (A/B) of the R—O—C Concentrated Part Occupying in the Grain Boundary>

As a typical example, an area ratio (A/B) of the R—O—C concentrated part occupying in the grain boundary was calculated from the mapping data of the R-T-B based sintered magnet of Ex. 1-4 by the following procedure.

(1) A backscattered electron image was binarized at a predetermined level, a main phase crystal grain part and a grain boundary part were specified, and then an area (B) of the grain boundary part was calculated. Note that the binarization was performed based on a signal intensity of a backscattered electron image. It is known that a signal intensity of the backscattered electron image is stronger when larger the content of an element having large atom number is. A rare earth element having a large atom number exists in the grain boundary part more than in the main phase part; and that it is a general method to perform a binarization specifying the main phase crystal grain part and the grain boundary part. In addition, even when an unspecified part of an interface of two grains generates by the binarization when measured, the unspecified part of an interface of two grains is within an error range of the entire grain boundary part, and that it does not affect a number range when calculating area (B) of the grain boundary part.

(2) An average amount and a standard deviation of characteristic X-ray intensity for each element Nd, O and C in the main phase crystal grain part specified in above (1) were calculated using a mapping data of a characteristic X-ray intensity of Nd, O and C obtained by EPMA.

(3) By the mapping data of a characteristic X-ray intensity of Nd, O and C obtained by EPMA, an area having larger characteristic X-ray intensity value than (an average amount+3× a standard deviation (three times a standard deviation)) of the characteristic X-ray intensity value in a main phase crystal grain part obtained by the above (2) is specified for each element; and the area was determined to have the element concentration highly distributed relative to that in a main phase crystal grain.

(4) A completely overlapping area of a grain boundary specified by the above (1) and an area wherein a concentration of each element Nd, O and C was higher than that in a main phase crystal grain specified by the above (3) was determined an R—O—C concentrated part in grain boundary; and its area (A) was calculated.

(5) An area ratio (A/B) of the R—O—C concentrated part occupying in the grain boundary was calculated by dividing an area (A) of the R—O—C concentrated part calculated by the above (4) with an area (B) of the grain boundary calculated by the above (1).

As a structure of thus obtained each R-T-B based sintered magnet according to Ex. 1-1 to Ex. 1-14, Comp. Ex. 1-1 to Comp. Ex. 1-6, an area ratio (A/B) of the R—O—C concentrated part occupying in the grain boundary was calculated. Results are shown in Table 2.

(Calculation of a ratio (O/R) of O atom to R atom)

Next, a quantitative analysis was performed to a composition of the R—O—C concentrated part. A quantitative analysis was performed to each element by EPMA with respect to the R—O—C concentrated part, specified by the EPMA mapping. A ratio (O/R) of O atom to R atom was calculated from the obtained concentration of each element. An average value of measured values at 5 points per a sample was determined (O/R) of the sample. The (O/R) value of each R-T-B based sintered magnet is shown in Table 2.

[Magnetic Properties]

Magnetic properties of the obtained respective R-T-B based sintered magnets were measured by B-H tracer. Residual magnetic flux density Br and coercivity HcJ were measured as the magnetic properties. Measured results of said residual magnetic flux density Br and of said coercivity HcJ according to each R-T-B based sintered magnets are shown in Table 2.

[Corrosion Resistance]

The obtained respective R-T-B based sintered magnets were machined to a plate form of 13 mm×8 mm×2 mm. These plate-like magnets were left in a saturated water vapor atmosphere of 100% relative humidity at 120° C. and 2 atmospheric pressure; and calculated a period of time when breakup of magnets by corrosion begins, namely when a rapid weight decrease by a powder falling begins. Evaluation results of time when breakup of magnets begins are shown in Table 2 as corrosion resistance of the each R-T-B based sintered magnet.

TABLE 2

| | Area ratio (%) of the R-O-C concentrated part occupying in a grain boundary | O/R | Oxygen amount (ppm) in a sintered body | Carbon amount (ppm) in a sintered body | Br(mT) | HcJ(kA/m) | Corrosion resistance |
|---|---|---|---|---|---|---|---|
| Ex. 1-1 | 14 | 0.41 | 910 | 870 | 1385 | 1684 | 240 h |
| Ex. 1-2 | 26 | 0.48 | 1130 | 960 | 1386 | 1698 | 400 h |
| Ex. 1-3 | 35 | 0.50 | 1240 | 1000 | 1385 | 1705 | 500 h No Corrosion |
| Ex. 1-4 | 45 | 0.64 | 1380 | 1020 | 1389 | 1693 | 500 h No Corrosion |
| Ex. 1-5 | 62 | 0.68 | 1670 | 1080 | 1384 | 1678 | 500 h No Corrosion |
| Ex. 1-6 | 71 | 0.70 | 1940 | 1130 | 1376 | 1654 | 500 h No Corrosion |
| Ex. 1-7 | 36 | 0.63 | 1340 | 1050 | 1384 | 1693 | 500 h No Corrosion |
| Ex. 1-8 | 41 | 0.68 | 1400 | 1070 | 1376 | 1654 | 500 h No Corrosion |
| Ex. 1-9 | 43 | 0.60 | 1310 | 1010 | 1390 | 1700 | 500 h No Corrosion |
| Ex. 1-10 | 38 | 0.53 | 1270 | 1050 | 1392 | 1682 | 500 h No Corrosion |
| Ex. 1-11 | 37 | 0.62 | 1450 | 1040 | 1418 | 1392 | 500 h No Corrosion |
| Ex. 1-12 | 47 | 0.63 | 1390 | 1060 | 1402 | 1325 | 500 h No Corrosion |
| Ex. 1-13 | 44 | 0.59 | 1420 | 1050 | 1291 | 2276 | 500 h No Corrosion |
| Ex. 1-14 | 47 | 0.65 | 1470 | 1020 | 1374 | 1968 | 500 h No Corrosion |
| Comp. Ex. 1-1 | 76 | 0.75 | 2260 | 1090 | 1385 | 1497 | 500 h No Corrosion |
| Comp. Ex. 1-2 | 9 | 0.29 | 430 | 740 | 1387 | 1662 | 60 h |
| Comp. Ex. 1-3 | 6 | 0.25 | 450 | 760 | 1415 | 1382 | 80 h |
| Comp. Ex. 1-4 | 9 | 0.35 | 420 | 720 | 1404 | 1312 | 60 h |
| Comp. Ex. 1-5 | 7 | 0.29 | 380 | 740 | 1290 | 2282 | 100 h |
| Comp. Ex. 1-6 | 9 | 0.36 | 510 | 780 | 1375 | 1957 | 80 h |

(Confirmation of a Diffraction Pattern)

Figure 11:
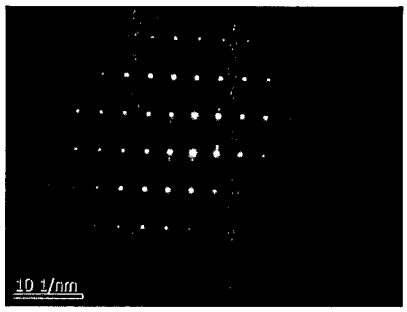
FIG. 11 is an example of an electron diffraction image according to an R—O—C concentrated part.

Further, an analysis was performed to a crystal structure of R—O—C concentrated part. The R—O—C concentrated part specified by EPMA mapping was processed using a focused ion beam process device (FIB) and a thin sample was manufactured. This thin sample of the R—O—C concentrated part was observed by transmission electron microscope and an electron diffraction image of the R—O—C concentrated part from various directions was obtained. A face indexing was performed to each diffraction point and its diffraction pattern was confirmed. An example of the electron diffraction image of the R—O—C concentrated part is shown in FIG. 11.

[Analysis of an Oxygen Amount and a Carbon Amount]

An oxygen amount was measured using an inert gas fusion—non-dispersive infrared absorption method and a carbon amount was measured using a combustion in an oxygen airflow—infrared absorption method; and an analysis of the oxygen amount and the carbon amount in R—O—C concentrated part was performed. The analysis of the oxygen amount and the carbon amount in each R-T-B based sintered magnet are shown in Table 2.

[Structure]

As shown in FIGS. 6 to 10, there exists an area, wherein each element of Nd, O and C is all highly distributed relative to that in a main phase crystal grain, in grain boundary of the R-T-B based sintered magnet of Ex. 1-4. The R—O—C concentrated part is thus confirmed to be present in the grain boundary.

<Calculation of an Area Ratio (A/B) of the R—O—C Concentrated Part Occupying in the Grain Boundary>

An area ratio (A/B) of the R—O—C concentrated part occupying in the grain boundary in the respective R-T-B based sintered magnet of Ex. 1-1 to Ex. 1-14 was within a range from 14% to 71%. Therefore, the R-T-B based sintered magnet obtained by each example is considered to include a predetermined area ratio (A/B) of R—O—C concentrated part in a grain boundary.

(Calculation of a Ratio (O/R) of O Atom to R Atom)

Further, a ratio (O/R) of O atom to R atom in the respective R-T-B based sintered magnet in Ex. 1-1 to Ex. 1-14 was within a range from 0.41 to 0.70. Therefore, R—O—C concentrated part in the respective R-T-B based sintered magnet of Ex. 1-1 to ex. 1-14 is considered to include a predetermined ratio (O/R) of O atom to R atom.

(Confirmation of a Diffraction Pattern)

An electron diffraction image of the R—O—C concentrated part from various directions was obtained. A face indexing was performed to each diffraction point; and it was identified that a diffraction pattern of the R—O—C concentrated part has a crystal orientation relation due to its cubic crystal structure. FIG. 11 is an example of the electron diffraction image. The R—O—C concentrated part is thus determined to have the cubic crystal structure.

[Analysis of an Oxygen Amount and a Carbon Amount]

Table 2 shows that an oxygen amount and a carbon amount included in a sintered body of each of the R-T-B based sintered magnets of Ex. 1-1 to Ex. 1-14 are higher than those of Comp. Ex. 1-2 to Comp. Ex. 1-6. Therefore, an addition of the oxygen source and the carbon source when mixing a fine pulverized powder in a main alloy and that in a sub alloy in a given ratio, and sintering thereof to manufacture a sintered body are considered to increase the oxygen amount and the carbon amount included in said sintered body.

[Magnetic Properties]

Table 2 shows that coercivity HcJ of the R-T-B based sintered magnet of Comp. Ex. 1-1 decreases relative to that of the respective R-T-B based sintered magnet of Ex. 1-1 to Ex. 1-14. Magnetic properties of the respective R-T-B based sintered magnet of Comp. Ex. 1-2 to Comp. Ex. 1-6 and those of the respective R-T-B based sintered magnet of Ex. 1-1 to Ex. 1-14 were almost the same level. Therefore, a sintered body, manufactured by an addition of the oxygen source and the carbon source when mixing a fine pulverized powder in a main alloy and that in a sub alloy in a given ratio and sintering thereof, is considered to have almost the same magnetic properties with those of a sintered body manufactured without an addition of the oxygen source and the carbon source.

[Corrosion Resistance]

Table 2 shows that a corrosion resistance of the respective R-T-B based sintered magnet of Ex. 1-1 to Ex. 1-14 improves to a large extent relative to that of the respective R-T-B based sintered magnet of Comp. Ex. 1-2 to Comp. Ex. 1-6. Thus, a corrosion resistance of the obtained R-T-B based sintered magnet is considered to improve by setting an area of the R—O—C concentrated part occupying in that of a grain boundary in an arbitrary cut surface of the R-T-B based sintered magnet within a predetermined range.

Considering above, an R-T-B based sintered magnet, having an R—O—C concentrated part in a grain boundary and having an area of the R—O—C concentrated part occupying in that of a grain boundary in an arbitrary cut surface of the R-T-B based sintered magnet within a predetermined range, is capable of showing an excellent corrosion resistance and good magnetic properties. Therefore, said R-T-B based sintered magnet according to the present embodiment can be used for a permanent magnet of such as a motor. For example, SPM motor having the magnet of the present embodiment is capable of showing a high output for a long term as well as maintaining motor characteristics, such as a torque characteristic of motor, and has an excellent reliability.

Hereinbefore, the R-T-B based sintered magnet according to the present embodiment may be preferably used for a magnet assembled in such as a motor.

Example 2

Manufacturing an R-T-B Based Sintered Magnet

Ex. 2-1 to Ex. 2-6, Comp. Ex. 2-1

To obtain sintered magnets having a composition of 21.20 wt % Nd—2.50 wt % Dy—7.20 wt % Pr—0.50 wt % Co—0.20 wt % Al—0.05 wt % Cu—1.00 wt % B—bal. Fe, an alloy for a sintered body (a raw material alloy) having the above composition was manufactured by a strip casting (SC) method at first. Two kinds, a main alloy, mainly forming a main phase of a magnet, and a sub alloy, mainly forming a grain boundary, were manufactured as the raw material alloy.

A hydrogen pulverization (a coarse pulverization) was then performed to the raw material alloy by storing hydrogen in each of the raw material alloy at a room temperature, and then by dehydrogenating thereof at 600° C. for an hour. The dehydrogenation was performed in a mixed atmosphere of Ar gas—Nitrogen gas; and a nitrogen additive amount was controlled by varying a concentration of nitrogen gas in an atmosphere as shown in Table 3. Note, in each example and comparative example, an oxygen concentration atmosphere during each step (a fine pulverization and a pressing) from hydrogen pulverization treatment to sintering was less than 50 ppm.

Next, after the hydrogen pulverization and before a fine pulverization, 0.1 wt % of oleic amide was added to the coarse pulverized powder of each raw material alloy as a pulverization aid, and then mixed by Nauta Mixer. And then, a fine pulverization was performed by a high pressure $N_2$ gas using a jet mill, obtaining a fine pulverized powder having an average particle diameter of around 4.0 μm.

Subsequently, the obtained fine pulverized powders of the main alloy and that of the sub alloy were mixed in a predetermined ratio, alumina particles as an oxygen source and carbon black particles as a carbon source were each added in an amount shown in Table 1, and mixed thereof using Nauta Mixer preparing mixed powders of a raw material powder of the R-T-B based sintered magnet.

TABLE 3

| | Nitrogen gas concentration (ppm) during dehydrogenation treatment | Alumina particle (wt %) | Carbon black particle (wt %) |
|---|---|---|---|
| Ex. 2-1 | 200 | 0.1 | 0.01 |
| Ex. 2-2 | 200 | 0.13 | 0.01 |
| Ex. 2-3 | 300 | 0.17 | 0.02 |
| Ex. 2-4 | 300 | 0.2 | 0.02 |
| Ex. 2-5 | 350 | 0.3 | 0.03 |
| Ex. 2-6 | 350 | 0.35 | 0.03 |
| Comp. Ex. 2-1 | 400 | 0.4 | 0.03 |

The obtained mixed powders were filled in a press mold placed in an electromagnet, a pressure of 120 MPa was applied while applying a magnetic field of 1200 kA/m, and then a green compact was obtained by pressing in a magnetic field. Subsequently, the obtained green compact was held and sintered in a vacuum at 1060° C. for 4 hours, and then rapidly cooled to obtain a sintered body (the R-T-B based sintered magnet) having the above composition. Next, a two-step aging treatment was performed to the obtained sintered body at 850° C. for an hour and at 540° C. for 2 hours (both in Ar gas atmosphere), and then rapidly cooled to obtain the R-T-B based sintered magnet of Ex. 2-1 to Ex. 2-6 and Comp. Ex. 2-1.

Ex. 2-7

The R-T-B based sintered magnet of Ex. 2-7 was obtained as similar with Ex. 2-4, except 0.33 wt % iron (III) oxide particles as an oxygen source and 0.1 wt % silicone carbide particles as a carbon source were used.

Ex. 2-8

The R-T-B based sintered magnet of Ex. 2-8 was obtained as similar with Ex. 2-4, except 0.38 wt % tricobalt tetroxide particles as an oxygen source and 0.7 wt % cast iron particles including iron carbide as a carbon source were used.

Ex. 2-9

The R-T-B based sintered magnet of Ex. 2-9 was obtained as similar with Ex. 2-4, except 0.6 wt % zirconia particle as an oxygen source and 0.03 wt % graphite particles as a carbon source were used.

Ex. 2-10

The R-T-B based sintered magnet of Ex. 2-10 was obtained as similar with Ex. 2-4, except 0.9 wt % cast iron particles having an oxidized surface as oxygen and carbon sources were used.

Ex. 2-11

To obtain a sintering magnet having a composition of 24.00 wt % Nd—8.00 wt % Pr—0.70 wt % Co—0.20 wt % Al—0.10 wt % Cu—0.40 wt % Ga—0.20 wt % Zr—0.92 wt % B—bal. Fe, the R-T-B based sintered magnet of Ex. 2-11 was obtained as similar with Ex. 2-4, except an alloy for a sintered body (a raw material alloy) having the above composition was manufactured by the SC method.

Ex. 2-12

To obtain a sintering magnet having a composition of 28.00 wt % Nd—3.50 wt % Dy—1.50 wt % Co—0.10 wt % Al—0.12 wt % Cu—0.20 wt % Ga—0.85 wt % B—bal. Fe, the R-T-B based sintered magnets of Ex. 2-12 were obtained as similar with Ex. 2-4, except an alloy for a sintered body (a raw material alloy) having the above composition was manufactured by the SC method.

Ex. 2-13

To obtain a sintering magnet having a composition of 25.00 wt % Nd—5.50 wt % Dy—1.00 wt % Co—0.30 wt % Al—0.10 wt % Cu—0.10 wt % Ga—0.15 wt % Zr—0.95 wt % B—bal. Fe, the R-T-B based sintered magnet of Ex. 2-13 was obtained as similar with Ex. 2-4, except an alloy for a sintered body (a raw material alloy) having the above composition was manufactured by the SC method.

Ex. 2-14

After machining the R-T-B based sintered magnet of Ex. 2-4 to have 3 mm thickness, a Dy dispersed slurry was applied to a magnet making a Dy adhered amount with respect to the magnet to 1%. A grain boundary diffusion treatment was performed to the magnet by a heat treatment in Ar atmosphere at 900° C. for 6 hours. An aging treatment at 540° C. for 2 hours was subsequently performed; and an R-T-B based sintered magnet of Ex. 2-14 was obtained. Note the grain boundary diffusion treatment is a treatment wherein a heavy rare earth element, such as Dy, is diffused in a grain boundary of the machined R-T-B based sintered magnet grain boundary, e.g. the grain boundary diffusion step (Step S19) as shown in the above FIG. 2 and the grain boundary diffusion step (Step S39) as shown in the above FIG. 5.

Comp. Ex. 2-2

The R-T-B based sintered magnet of Comp. Ex. 2-2 was obtained as similar with Ex. 2-1 to Ex. 2-6 and Comp. Ex. 2-1, except an oxygen source and a carbon source were not added, and a nitrogen gas concentration during dehydrogenation treatment of the coarse pulverization was 100 ppm or less.

Comp. Ex. 2-3 to Comp. Ex. 2-6

The R-T-B based sintered magnets of Comp. Ex. 2-3 to Comp. Ex. 2-6 were obtained as similar with Ex. 2-11 to Ex. 2-14, except an oxygen source and a carbon source were not added, and a nitrogen gas concentration during dehydrogenation treatment of the coarse pulverization was 100 ppm or less.

<Evaluation>

An structure of the manufactured respective R-T-B based sintered magnet, amounts of oxygen (O amount), carbon (C amount) and nitrogen (N amount) included in the respective R-T-B based sintered magnet, magnetic properties and corrosion resistances of the respective R-T-B based sintered magnet were measured and evaluated. An area ratio (A/B) of the respective R—O—C—N concentrated part occupying in grain boundary was obtained as the evaluation of the structure. Residual magnetic flux density Br and coercivity HcJ of the respective R-T-B based sintered magnet were measured as the evaluation of the magnetic properties.

[Structure]

<Observation of an Element Distribution>

Figure 12:
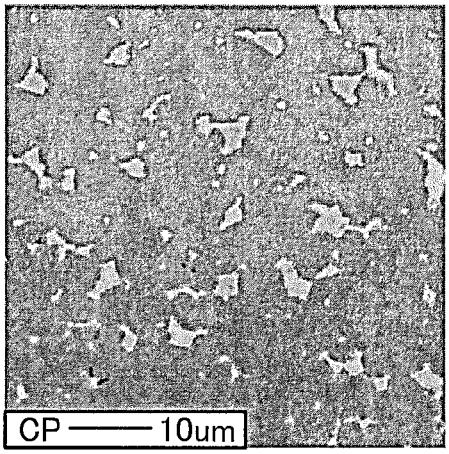
FIG. 12 is a backscattered electron image of the R-T-B based sintered magnet cut surface according to Ex. 2-4.
Figure 13:
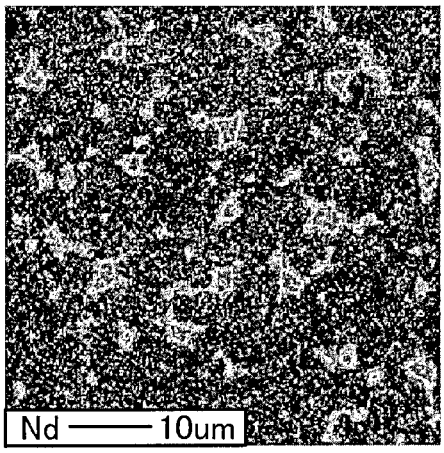
FIG. 13 is a mapping data of Nd in the R-T-B based sintered magnet cut surface according to Ex. 2-4.
Figure 14:
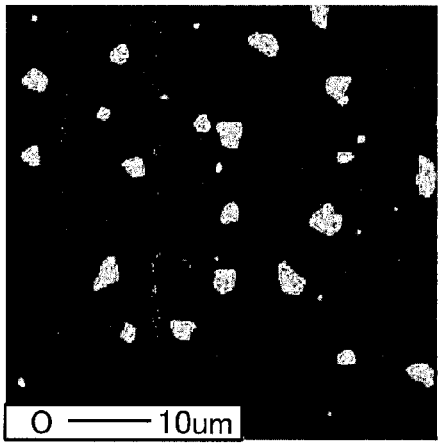
FIG. 14 is a mapping data of O in the R-T-B based sintered magnet cut surface according to Ex. 2-4.
Figure 15:
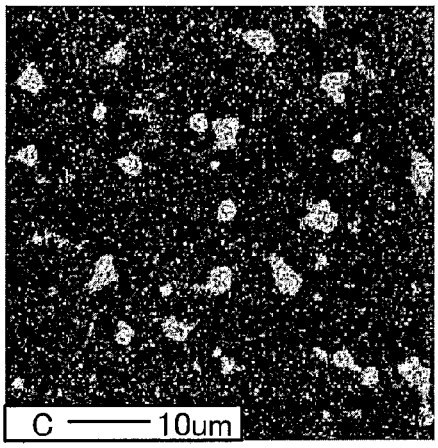
FIG. 15 is a mapping data of C in the R-T-B based sintered magnet cut surface according to Ex. 2-4.
Figure 16:
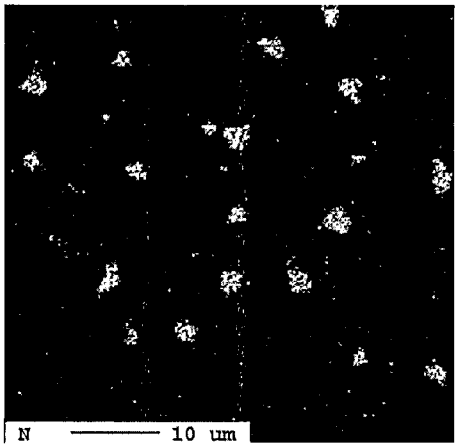
FIG. 16 is a mapping data of N in the R-T-B based sintered magnet cut surface according to Ex. 2-4.
Figure 17:
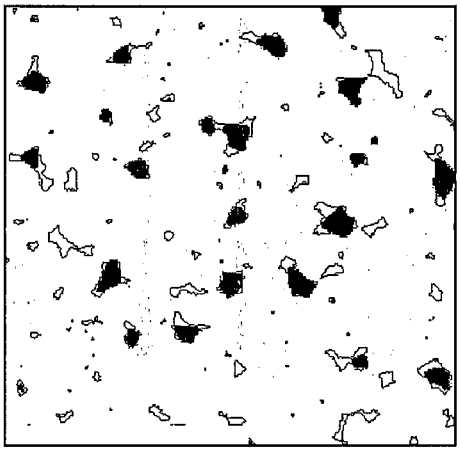
FIG. 17 is a figure showing an dispersed area (an R—O—C—N concentrated part) wherein a concentration of each element Nd, O, C and N in the R-T-B based sintered magnet cut surface according to Ex. 2-4 is higher than that of a crystal grain in main phase.

After a surface of a cross-section of the obtained respective R-T-B based sintered magnet was milled by an ion milling removing effects of the outermost surface such as oxidation and the like, an element distribution of the cross-section of the R-T-B based sintered magnet was observed by EPMA (Electron Probe Micro Analyzer) and analyzed thereof. A 50 μm square area of the structure according to the R-T-B based sintered magnet of Ex. 2-4 was observed by EPMA; and then an elemental mapping (256 points×256 points) by EPMA was performed. FIG. 12 is a backscattered electron image of the R-T-B based sintered magnet cut surface of Ex. 2-4. FIGS. 13 to 16 respectively show an observation result of each element Nd, O, C and N in the R-T-B based sintered magnet cut surface of Ex. 2-4. In addition, an area (an R—O—C—N concentrated part), wherein a concentration of each element Nd, O, C and N in the R-T-B based sintered magnet cut surface of Ex. 2-4 is highly distributed than that in a main phase of crystal grain, is shown in FIG. 17.

<Calculation of an Area Ratio (A/B) of the R—O—C—N Concentrated Part Occupying in the Grain Boundary>

As a typical example, an area ratio (A/B) of the R—O—C—N concentrated part occupying in the grain boundary was calculated from the mapping data of the R-T-B based sintered magnet of Ex. 2-4 by the following procedure.

(1) A backscattered electron image was binarized at a predetermined level, a main phase crystal grain part and a grain boundary part were specified, and then an area (B) of the grain boundary part was calculated. Note that the binarization was performed based on a signal intensity of a backscattered electron image. It is known that a signal intensity of the backscattered electron image is stronger when larger the content of an element having large atom number is. A rare earth element having a large atom number exists in the grain boundary part more than in the main phase part; and that it is a general method to perform a binarization specifying the main phase crystal grain part and the grain boundary part. In addition, even when an unspecified part of an interface of two grains generates by the binarization when measured, the unspecified part of an interface of two grains is within an error range of the entire grain boundary part, and that it does not affect a number range when calculating area (B) of the grain boundary part.

(2) An average amount and a standard deviation of characteristic X-ray intensity for each element Nd, O, C and N in the main phase crystal grain part specified in above (1) were calculated using a mapping data of a characteristic X-ray intensity of Nd, O, C and N obtained by EPMA.

(3) By the mapping data of a characteristic X-ray intensity of Nd, O, C and N obtained by EPMA, an area having larger characteristic X-ray intensity value than (an average amount+3× a standard deviation (three times a standard deviation)) of the characteristic X-ray intensity value in a main phase crystal grain part obtained by the above (2) is specified for each element; and the area was determined to have the element concentration highly distributed relative to that in a main phase crystal grain.

(4) A completely overlapping area of a grain boundary specified by the above (1) and an area wherein a concentration of each element Nd, O, C and N was higher than that in a main phase crystal grain specified by the above (3) was determined an R—O—C—N concentrated part in grain boundary; and its area (A) was calculated.

(5) An area ratio (A/B) of the R—O—C—N concentrated part occupying in the grain boundary was calculated by dividing an area (A) of the R—O—C—N concentrated part calculated by the above (4) with an area (B) of the grain boundary calculated by the above (1).

As a structure of thus obtained each R-T-B based sintered magnet according to Ex. 2-1 to Ex. 2-14, Comp. Ex. 2-1 to Comp. Ex. 2-6, an area ratio (A/B) of the R—O—C—N concentrated part occupying in the grain boundary was calculated. Results are shown in Table 4.

(Calculations of a Ratio (O/R) of O Atom to R Atom and a Ratio (N/R) of N Atom to R Atom)

Next, a quantitative analysis was performed to a composition of the R—O—C—N concentrated part. A quantitative analysis was performed to each element by EPMA with respect to the R—O—C—N concentrated part, specified by the EPMA mapping. A ratio (O/R) of O atom to R atom was calculated from the obtained concentration of each element. An average value of measured values at 5 points per a sample was determined (O/R) of the sample. Similarly, a ratio (N/R) of N atom to R atom was calculated from the obtained concentration of each element; and an average value of measured values at 5 points per a sample was determined (N/R) of the sample. The (O/R) and (N/R) values of each R-T-B based sintered magnet are shown in Table 4.

(Confirmation of a Diffraction Pattern)

Figure 18:
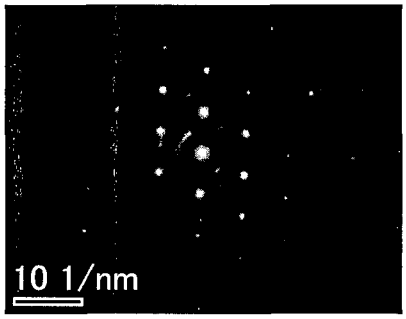
FIG. 18 is an example of an electron diffraction image according to an R—O—C—N concentrated part.

Further, similarly with the above Example 1, an analysis was performed to a crystal structure of R—O—C—N concentrated part. An example of the electron diffraction image of the R—O—C—N concentrated part is shown in FIG. 18.

[Analysis of an Oxygen Amount, a Carbon Amount and a Nitrogen Amount]

An oxygen amount was measured using an inert gas fusion—non-dispersive infrared absorption method, a carbon amount was measured using a combustion in an oxygen airflow—infrared absorption method and a nitrogen amount was measured using an inert gas fusion—thermal conductivity method; and an analysis of the oxygen amount, the carbon amount and the nitrogen amount in the R-T-B based sintered magnet was performed. The analysis of the oxygen amount, the carbon amount and the nitrogen amount in each R-T-B based sintered magnet is shown in Table 4.

[Magnetic Properties]

Similarly with the above Example 1, residual magnetic flux density Br and coercivity HcJ were measured as the magnetic properties of the obtained respective R-T-B based sintered magnet. Measured results of said residual magnetic flux density Br and of said coercivity HcJ according to each R-T-B based sintered magnet are shown in Table 4.

[Corrosion Resistance]

Similarly with the above examples, the obtained respective R-T-B based sintered magnets were machined to a plate form of 13 mm×8 mm×2 mm. These plate-like magnets were left in a saturated water vapor atmosphere of 100% relative humidity at 120° C. and 2 atmospheric pressure; and calculated a period of time when breakup of a magnet by corrosion begins, namely when a rapid weight decrease by a powder falling begins. Evaluation results of time when breakup of a magnet begins are shown in Table 4 as corrosion resistance of the each R-T-B based sintered magnet.

TABLE 4

| | Area ratio (%) of the R-O-C-N concentrated part occupying in a grain boundary | O/R | N/R | Oxygen amount (ppm) in a sintered body | Carbon amount (ppm) in a sintered body | Nitrogen amount (ppm) in a sintered body | Br(mT) | HcJ(kA/m) | Corrosion resistance |
|---|---|---|---|---|---|---|---|---|---|
| Ex. 2-1 | 13 | 0.41 | 0.49 | 860 | 830 | 420 | 1384 | 1679 | 240 h |
| Ex. 2-2 | 28 | 0.48 | 0.43 | 1120 | 950 | 450 | 1387 | 1687 | 400 h |
| Ex. 2-3 | 36 | 0.50 | 0.34 | 1250 | 1010 | 490 | 1385 | 1708 | 500 h No Corrosion |
| Ex. 2-4 | 44 | 0.62 | 0.29 | 1370 | 1030 | 500 | 1388 | 1698 | 500 h No Corrosion |
| Ex. 2-5 | 64 | 0.67 | 0.23 | 1690 | 1070 | 570 | 1385 | 1682 | 500 h No Corrosion |
| Ex. 2-6 | 72 | 0.70 | 0.16 | 1950 | 1140 | 600 | 1377 | 1661 | 500 h No Corrosion |
| Ex. 2-7 | 38 | 0.64 | 0.28 | 1320 | 1070 | 510 | 1385 | 1693 | 500 h No Corrosion |
| Ex. 2-8 | 44 | 0.67 | 0.25 | 1380 | 1050 | 490 | 1378 | 1657 | 500 h No Corrosion |
| Ex. 2-9 | 46 | 0.58 | 0.30 | 1330 | 1030 | 530 | 1389 | 1703 | 500 h No Corrosion |

TABLE 4-continued

| | Area ratio (%) of the R-O-C-N concentrated part occupying in a grain boundary | O/R | N/R | Oxygen amount (ppm) in a sintered body | Carbon amount (ppm) in a sintered body | Nitrogen amount (ppm) in a sintered body | Br(mT) | HcJ(kA/m) | Corrosion resistance |
|---|---|---|---|---|---|---|---|---|---|
| Ex. 2-10 | 37 | 0.51 | 0.32 | 1290 | 1020 | 480 | 1391 | 1678 | 500 h No Corrosion |
| Ex. 2-11 | 36 | 0.61 | 0.29 | 1420 | 1010 | 520 | 1391 | 1412 | 500 h No Corrosion |
| Ex. 2-12 | 42 | 0.59 | 0.31 | 1360 | 1040 | 480 | 1364 | 1860 | 500 h No Corrosion |
| Ex. 2-13 | 49 | 0.63 | 0.28 | 1400 | 1020 | 540 | 1282 | 2073 | 500 h No Corrosion |
| Ex. 2-14 | 48 | 0.65 | 0.25 | 1460 | 1050 | 490 | 1378 | 1976 | 500 h No Corrosion |
| Comp. Ex. 2-1 | 76 | 0.75 | 0.12 | 2230 | 1130 | 640 | 1384 | 1495 | 500 h No Corrosion |
| Comp. Ex. 2-2 | 9 | 0.29 | 0.51 | 430 | 740 | 280 | 1387 | 1662 | 60 h |
| Comp. Ex. 2-3 | 6 | 0.25 | 0.53 | 480 | 790 | 340 | 1393 | 1402 | 40 h |
| Comp. Ex. 2-4 | 7 | 0.28 | 0.52 | 390 | 760 | 320 | 1365 | 1849 | 100 h |
| Comp. Ex. 2-5 | 9 | 0.34 | 0.51 | 460 | 720 | 350 | 1284 | 2061 | 60 h |
| Comp. Ex. 2-6 | 9 | 0.35 | 0.50 | 520 | 760 | 300 | 1376 | 1964 | 80 h |

[Structure]

As shown in FIGS. 12 to 17, there exists an area, wherein each element of Nd, O, C and N is all highly distributed relative to that in a main phase crystal grain, in grain boundary of the R-T-B based sintered magnet of Ex. 2-4. The R—O—C—N concentrated part is thus confirmed to be present in the grain boundary.

<Calculation of an Area Ratio (A/B) of the R—O—C—N Concentrated Part Occupying in the Grain Boundary>

An area ratio (A/B) of the R—O—C—N concentrated part occupying in the grain boundary in the respective R-T-B based sintered magnet of Ex. 2-1 to Ex. 2-14 was within a range from 13% to 72%. Therefore, the R-T-B based sintered magnet obtained by each example is considered to include a predetermined area ratio (A/B) of R—O—C—N concentrated part in a grain boundary.

(Calculation of a Ratio (O/R) of O Atom to R Atom)

Further, a ratio (O/R) of O atom to R atom in the respective R-T-B based sintered magnet in Ex. 2-1 to Ex. 2-14 was within a range from 0.41 to 0.70. Therefore, R—O—C—N concentrated part of R-T-B based sintered magnet obtained in the respective example is considered to include a predetermined ratio (O/R) of O atom to R atom.

(Confirmation of a Diffraction Pattern)

An electron diffraction image of the R—O—C—N concentrated part from various directions was obtained. A face indexing was performed to each diffraction point; and it was identified that a diffraction pattern of the R—O—C—N concentrated part has a crystal orientation relation due to its cubic crystal structure. FIG. 18 is an example of the electron diffraction image. The R—O—C—N concentrated part is thus determined to have the cubic crystal structure.

[Analysis of an Oxygen Amount, a Carbon Amount and a Nitrogen Amount]

Table 4 shows that an oxygen amount, a carbon amount and a nitrogen amount included in a sintered body of the respective R-T-B based sintered magnet of Ex. 2-1 to Ex. 2-14 are higher than those of Comp. Ex. 2-2 to Comp. Ex. 2-6. Therefore, an addition of the oxygen source and the carbon source when mixing a fine pulverized powder in a main alloy and that in a sub alloy in a given ratio, and sintering thereof to manufacture a sintered body are considered to increase the oxygen amount and the carbon amount included in said sintered body. Further, an increase of nitrogen gas concentration during dehydrogenation treatment of a coarse pulverization is considered to increase nitrogen amount included in the sintered body.

[Magnetic Properties]

Table 4 shows that coercivity HcJ of the R-T-B based sintered magnet of Comp. Ex. 2-1 decreases relative to that of the respective R-T-B based sintered magnet of Ex. 2-1 to Ex. 2-14. Magnetic properties of the respective R-T-B based sintered magnet of Comp. Ex. 2-2 to Comp. Ex. 2-6 and those of the respective R-T-B based sintered magnet of Ex. 2-1 to Ex. 2-14 were almost the same level. Considering above, a sintered body wherein an oxygen amount, a carbon amount and a nitrogen amount are increased can be obtained by raising a nitrogen gas concentration when coarsely pulverizing the dehydrogenation treated main alloy and sub alloy, and by adding an oxygen source and a carbon source when mixing each fine pulverized powder of the main alloy and the sub alloy. Thus obtained sintered body is considered to have almost the same magnetic properties with those of a sintered body, obtained by controlling an additional amount of nitrogen without increasing a nitrogen gas concentration when dehydrogenation and a coarse pulverization are performed and without adding the oxygen source and the carbon source.

[Corrosion Resistance]

Table 4 shows that a corrosion resistance of the respective R-T-B based sintered magnet of Ex. 2-1 to Ex. 2-14 improves to a large extent relative to that of the respective R-T-B based sintered magnet of Comp. Ex. 2-2 to Comp. Ex. 2-6. Thus, a corrosion resistance of the obtained R-T-B based sintered magnet is considered to improve by setting an area of the R—O—C—N concentrated part occupying in that of a grain boundary in an arbitrary cut surface of the R-T-B based sintered magnet within a predetermined range.

Considering above, an R-T-B based sintered magnet, having an R—O—C—N concentrated part in a grain boundary and having an area of the R—O—C—N concentrated part occupying in that of a grain boundary in an arbitrary cut surface of the R-T-B based sintered magnet within a predetermined range, is capable of showing an excellent corrosion resistance and good magnetic properties. Therefore, in case when said R-T-B based sintered magnet according to the present embodiment is used for a permanent magnet of such as a motor. For example, SPM motor having the magnet of the present embodiment is capable of showing a high output for a long term as well as maintaining motor characteristics, such as a torque characteristic of motor, and becomes to have an excellent reliability.

Hereinbefore, the R-T-B based sintered magnet according to the present embodiment may be preferably used for a magnet assembled in such as a motor.

DESCRIPTION OF THE REFERENCE NUMERALS

10 SPM motor
11 housing
12 rotor
13 stator
14 rotary shaft
15 rotor core (iron core)
16 permanent magnet
17 magnet insert slot
18 stator core
19 throttle
20 coil

The invention claimed is:

1. An R-T-B based sintered magnet comprising $R_2T_{14}B$ crystal grains and grain boundaries formed by two or more adjacent $R_2T_{14}B$ crystal grains, wherein:

R represents at least one rare earth element;

T represents at least one transition metal element comprising Fe or Fe and Co;

the grain boundaries comprise R—O—C concentrated parts;

the R—O—C concentrated parts are entire areas of the grain boundaries have concentrations of R, O, and C that are higher than concentrations of R, O, and C in the $R_2T_{14}B$ crystal grains;

an average area ratio of the total R—O—C concentrated parts to the entire grain boundaries is within a range of 14% or more to 71% or less, and an average ratio (O/R) of O atom to R atom in the R—O—C concentrated parts is within a range of 0.41 or more to 0.70 or less.

2. The R-T-B based sintered magnet as set forth in claim 1, wherein the R—O—C concentrated parts comprise a cubic crystal structure.

3. The R-T-B based sintered magnet as set forth in claim 2, wherein the average area ratio of the total R—O—C concentrated parts to the entire grain boundaries is within a range of 35% or more to 71% or less.

4. The R-T-B based sintered magnet as set forth in claim 3, wherein an oxygen amount included in the R-T-B based sintered magnet is 1940 ppm or less.

5. The R-T-B based sintered magnet as set forth in claim 4, wherein "R" included in the R—O—C concentrated parts comprise a rare earth element that at least includes either or both of Nd and Pr (RL), and a rare earth element that at least includes either or both of Dy and Tb (RH).

6. The R-T-B based sintered magnet as set forth in claim 1, wherein a coercivity of the R-T-B based sintered magnet is 1325 kA/m or more.

7. The R-T-B based sintered magnet as set forth in claim 1, wherein a coercivity of the R-T-B based sintered magnet is 1325 kA/m to 2276 kA/m.

8. The R-T-B based sintered magnet as set forth in claim 1, wherein a magnetic flux density of the R-T-B based sintered magnet is 1291 mT or more.

9. The R-T-B based sintered magnet as set forth in claim 1, wherein a magnetic flux density of the R-T-B based sintered magnet is 1291 to 1418 mT.

10. An R-T-B based sintered magnet comprising $R_2T_{14}B$ crystal grains and grain boundaries formed by two or more adjacent $R_2T_{14}B$ crystal grains, wherein:

R represents at least one rare earth element;

T represents at least one transition metal element comprising Fe or Fe and Co;

the grain boundaries comprise R—O—C—N concentrated parts;

the R—O—C—N concentrated parts are entire areas of the grain boundaries that have concentrations of R, O, C, and N that are higher than concentrations of R, O, C, and N in the $R_2T_{14}B$ crystal grains; and an average area ratio of the total R—O—C—N concentrated parts to the entire grain boundaries is within a range of 13% or more to 72% or less.

11. The R-T-B based sintered magnet as set forth in claim 10, wherein an average ratio (O/R) of O atom to R atom in the R—O—C—N concentrated parts is within a range of 0.41 or more to 0.70 or less.

12. The R-T-B based sintered magnet as set forth in claim 11, wherein the R—O—C—N concentrated parts comprise a cubic crystal structure.

13. The R-T-B based sintered magnet as set forth in claim 12, wherein the average area ratio of the total R—O—C—N concentrated parts to the entire grain boundaries is within a range of 36% or more to 72% or less.

14. The R-T-B based sintered magnet as set forth in claim 13, wherein an oxygen amount included in the R-T-B based sintered magnet is 1950 ppm or less.

15. The R-T-B based sintered magnet as set forth in claim 14, wherein "R" included in the R—O—C—N concentrated parts comprise a rare earth element that at least includes either or both of Nd and Pr (RL), and a rare earth element that at least includes either or both of Dy and Tb (RH).

16. The R-T-B based sintered magnet as set forth in claim 10, wherein a coercivity of the R-T-B based sintered magnet is 1412 kA/m or more.

17. The R-T-B based sintered magnet as set forth in claim 10, wherein a coercivity of the R-T-B based sintered magnet is 1412 to 2073 kA/m.

18. The R-T-B based sintered magnet as set forth in claim 10, wherein a magnetic flux density of the R-T-B based sintered magnet is 1282 mT or more.

19. The R-T-B based sintered magnet as set forth in claim 10, wherein a magnetic flux density of the R-T-B based sintered magnet is 1282 to 1391 mT.

* * * * *